US011202942B1

(12) United States Patent
Zamora

(10) Patent No.: US 11,202,942 B1
(45) Date of Patent: Dec. 21, 2021

(54) SPORTS BALL WITH CONTROLLABLE TRAJECTORY

(71) Applicant: Jazmine Zamora, Ewa Beach, HI (US)

(72) Inventor: Jazmine Zamora, Ewa Beach, HI (US)

( * ) Notice: Subject to any disclaimer, the term of this patent is extended or adjusted under 35 U.S.C. 154(b) by 0 days.

(21) Appl. No.: 16/812,308

(22) Filed: Mar. 7, 2020

Related U.S. Application Data

(63) Continuation-in-part of application No. 15/791,264, filed on Oct. 23, 2017, now Pat. No. 10,850,166.

(60) Provisional application No. 62/410,865, filed on Oct. 21, 2016.

(51) Int. Cl.

| | |
|---|---|
| ***A63B 43/00*** | (2006.01) |
| ***A63B 69/00*** | (2006.01) |
| ***A63B 37/14*** | (2006.01) |
| ***A63B 69/40*** | (2006.01) |
| *A63B 102/18* | (2015.01) |

(52) U.S. Cl.
CPC ..... *A63B 43/002* (2013.01); *A63B 69/406* (2013.01); *A63B 37/14* (2013.01); *A63B 69/0002* (2013.01); *A63B 2069/0008* (2013.01); *A63B 2069/401* (2013.01); *A63B 2069/403* (2013.01); *A63B 2102/182* (2015.10)

(58) Field of Classification Search
CPC ..... A63B 43/002; A63B 37/14; A63B 69/406; A63B 2069/401; A63B 2102/182; A63B 69/0002; A63B 2069/403
See application file for complete search history.

(56) References Cited

U.S. PATENT DOCUMENTS

| | | | | | |
|---|---|---|---|---|---|
| 1,150,761 | A * | 8/1915 | Hartman | A63F 7/044 | 273/112 |
| 2,135,210 | A * | 11/1938 | Farrar | A63B 37/0004 | 473/383 |
| 2,776,139 | A * | 1/1957 | Blamey, Jr. | A63B 43/00 | 473/613 |
| 4,128,238 | A * | 12/1978 | Newcomb | A63B 37/14 | 273/DIG. 20 |
| 4,256,304 | A * | 3/1981 | Smith | A63B 37/14 | 473/451 |
| 4,438,924 | A * | 3/1984 | Carr | A63B 37/14 | 473/613 |
| 4,874,169 | A * | 10/1989 | Litchfield | A63B 37/14 | 473/613 |
| 5,280,906 | A * | 1/1994 | Vitale | A63B 43/00 | 473/613 |

(Continued)

OTHER PUBLICATIONS

Rogers, Tony, "Everything You Need to Know About Polyethylene (PE)", <https://www.creativemechanisms.com/blog/polyethylene-pe-for-prototypes-3d-printing-and-cnc>, retrieved on Apr. 23, 2021, dated Sep. 14, 2015. (Year: 2015).*

*Primary Examiner* — Steven B Wong
(74) *Attorney, Agent, or Firm* — Hawaii Patent Services; Nathaniel K. Fedde

(57) ABSTRACT

This invention provides sports ball having asymmetrical traction and/or asymmetrical surface structure. The asymmetrical traction is useful for differentially controlling ball spin and trajectory height as the ball is projected from a pitching machine. The asymmetrical surface structure is useful for differentially controlling the lateral component of the ball's trajectory. Optionally, the ball is a pitching machine ball. The method also provides a method of projecting the ball from a pitching machine.

17 Claims, 20 Drawing Sheets

(56) References Cited

U.S. PATENT DOCUMENTS

| | | | | | |
|---|---|---|---|---|---|
| 5,588,648 | A * | 12/1996 | Stebbins | A63B 37/02 | 473/451 |
| 5,647,590 | A * | 7/1997 | Walker | A63B 37/00 | 473/601 |
| 5,700,211 | A * | 12/1997 | Mackie | A63B 43/00 | 473/613 |
| 6,012,997 | A * | 1/2000 | Mason | A63B 43/00 | 273/DIG. 20 |
| 6,354,970 | B1 * | 3/2002 | Reinke | A63B 37/00 | 473/600 |
| 6,837,814 | B2 * | 1/2005 | Thomas | A63B 37/14 | 473/613 |
| D539,367 | S * | 3/2007 | Jones | D21/713 | |
| 7,608,003 | B1 * | 10/2009 | Fusco | A63B 43/00 | 473/613 |
| D648,406 | S * | 11/2011 | Hochberg | D21/713 | |
| 10,850,166 | B1 * | 12/2020 | Zamora | A63B 37/14 | |
| 2007/0155549 | A1 * | 7/2007 | Keker | A63B 69/0002 | 473/613 |

* cited by examiner

SPORTS BALL WITH CONTROLLABLE TRAJECTORY

CROSS-REFERENCE TO RELATED APPLICATIONS

This application claims the benefit of U.S. Provisional Application No. 62/410,865 filed 21 Oct. 2017, which is hereby incorporated by reference.

TECHNICAL FIELD

The present invention relates to generally to sports balls, and more particularly to sports balls for use in pitching machines, particularly of the type having at least one drive wheel.

BACKGROUND

Pitching machines have become a staple of batting practice at all levels of play. One of the most popular types of pitching machines includes a rotating drive wheel that contacts the ball to project the ball towards the batter. The ball is fed, for example, through a ball chute and typically is pinched or squeezed as it is pulled under a pinch plate (sometimes called a bumper pad) by the wheel. This squeezing action forces the ball against the wheel and allows the wheel to project the ball. While these pitching machines can provide continuous batting practice for a batter, they typically only pitch a single trajectory that is straight at the batter with little or no variance in vertical trajectory.

One solution to this problem has been the multi-wheeled pitching machine which can pitch curveballs, sinkers, and other types of pitches by varying the relative speed of the multiple wheels that contact the ball. However, these pitching machines are expensive, making them less available to all levels of players, and have more parts, making them more prone to failure. Further, their size and portability provide additional limitations.

What is needed in the art is a pitching machine ball that can be projected from a single wheel pitching machine and provide the user with control over vertical and/or trajectory of the ball.

SUMMARY OF THE INVENTION

One aspect of the invention provides a sports ball having asymmetrical traction and/or asymmetrical surface shape. Another aspect of the invention provides a method of projecting ('pitching') the ball from a pitching machine having a drive wheel that contacts the ball.

For example, a ball of the present invention optionally comprises asymmetrical traction such that the ball surface comprises a plurality of portions with differing traction when independently interfaced with the drive wheel of a pitching machine. Additionally or alternatively, the ball is optionally asymmetrically shaped to differentially modulate relative air pressure about non-overlapping hemispheres as the ball travels through air. Such a ball having asymmetrically shaped to differently modulate air pressure is sometimes said to have a 'horizontal trajectory-controlling structure'.

Optionally, the asymmetrical traction and/or the asymmetrical shape is provided by a groove pattern.

Optionally, the ball comprises a non-perforated outer surface.

Optionally, the ball comprises a solid core. Optionally, the ball is substantially solid.

Optionally, the surface of the ball comprises a plurality of dimples. Optionally, the dimples are evenly spaced about the entire surface of the ball or a portion (e.g. hemisphere) thereof.

Optionally, the groove pattern comprises one or more arcuate grooves formed in the surface of the ball, wherein the one are more arcuate grooves are provided to a greater extent in a first hemisphere of the ball than a second hemisphere of the ball (e.g. to provide asymmetrical traction and/or asymmetrical surface shape), and wherein the path of the one are more arcuate grooves is non-perpendicular to an equator that joins the first hemisphere and the second hemisphere. Optionally, the path of the one or more arcuate grooves is substantially parallel to the equator. Optionally, the surface of the second hemisphere does not comprise said one or more arcuate grooves. Optionally, the one are more arcuate grooves are concentric about an axis of the ball that is perpendicular to the equator.

A method of the invention comprises placing the ball on a drive wheel of a pitching machine, and propelling the ball by spinning the drive wheel. According to a method of the present invention, the trajectory of the ball can be manipulated, relative to a comparator ball (e.g. a symmetrical ball and/or ball having the same composition but not modified according to the present invention) by differentially orienting the horizontal trajectory-controlling structure and/or asymmetrical traction in the step of placing the ball on the drive wheel. The step of placing the ball on a drive wheel can comprise any of:

a. orienting the ball of the invention to offset the horizontal trajectory-controlling structure to the right or left of a center plane of the drive wheel, whereby the ball of the invention is propelled about a trajectory offset to the right or left relative to the comparator ball;
b. orienting the ball of the invention on the drive wheel such that the wheel-ball interaction is dominated by the ball portion having greater traction, whereby the ball of the invention is propelled about a trajectory that is higher relative to when the ball of the invention is oriented such that the wheel-ball interaction is dominated by the ball portion having less traction; and
c. orienting the ball of the invention on the drive wheel such that the wheel-ball interaction is dominated by the ball portion having less traction, whereby the ball of the invention is propelled about a trajectory that is lower relative to when the ball of the invention is oriented such that the wheel-ball interaction is dominated by the ball portion having greater traction.

BRIEF DESCRIPTION OF THE DRAWINGS

FIG. 1A depicts a perspective view, shaded with stippling to show contour. FIG. 1B depicts a side elevation view. FIG. 1C depicts a front elevation view. FIG. 1D depicts a rear elevation view. FIG. 1E depicts a perspective view. FIG. 1F depicts a cross section view. The cross section to provide FIG. 1F is taken from a plane labeled as "1F" in FIG. 1C. FIG. 1G depicts an exploded view.

FIG. 3A depicts a higher trajectory ('high mode'). resulting from greater backspin. FIG. 3B depicts a lower trajectory ('low mode'). resulting from less backspin.

FIG. 6A depicts a perspective view, shaded with stippling to show contour. FIG. 6B depicts a cross section view. The cross section to provide FIG. 6B is taken from a plane oriented in the same manner with respect to the view shown in FIG. 6A as plane "1F" is oriented with respect to the view shown in FIG. 10.

DETAILED DESCRIPTION OF THE INVENTION

Figure 1A:
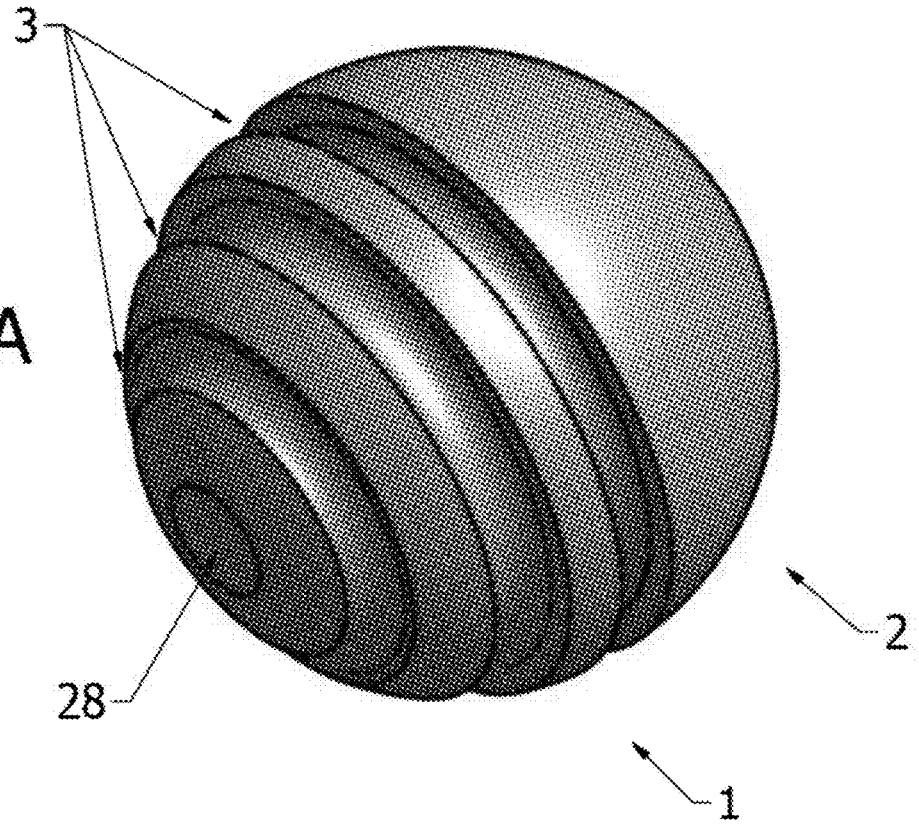
FIGS. 1A-1G depict views of a ball of the invention.
Figure 1B:
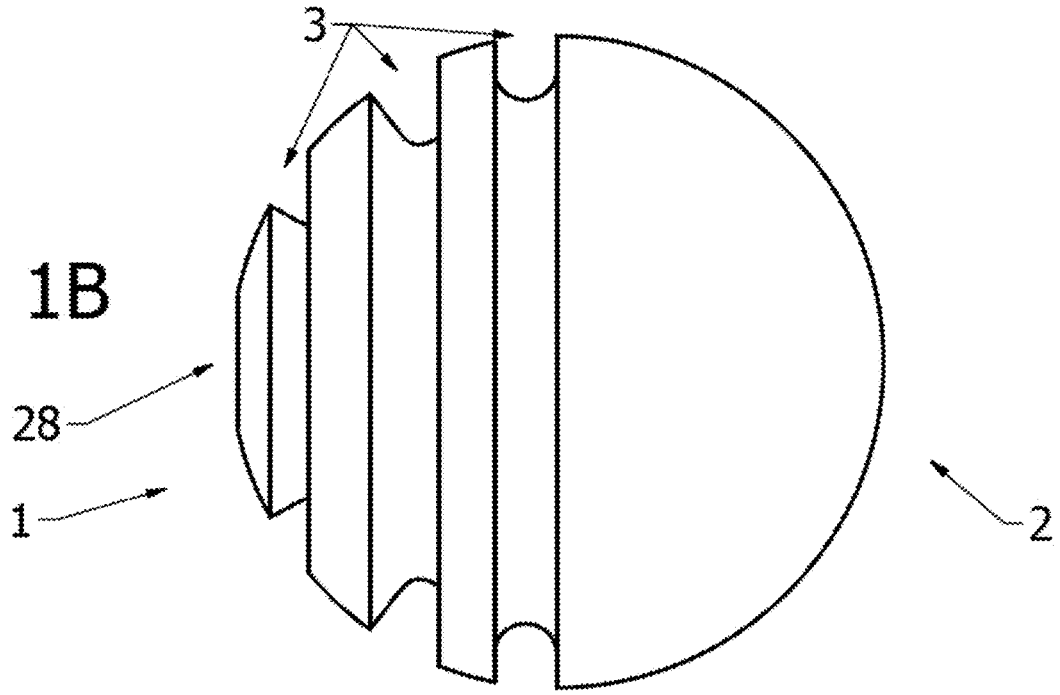
Figure 1C:
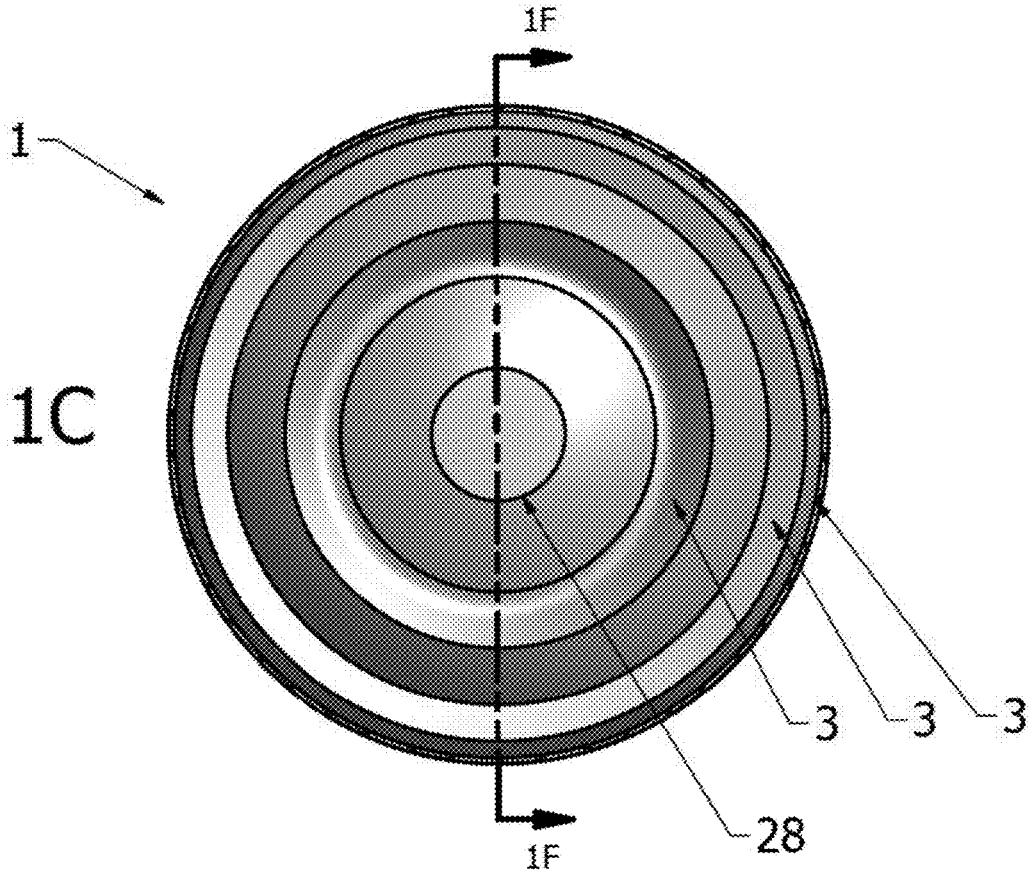
Figure 1D:
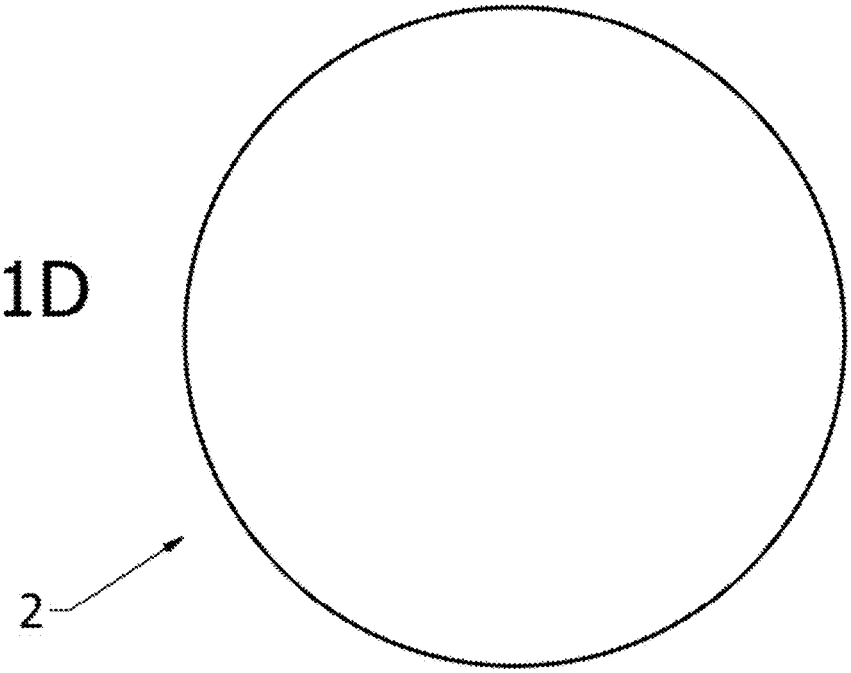
Figure 1E:
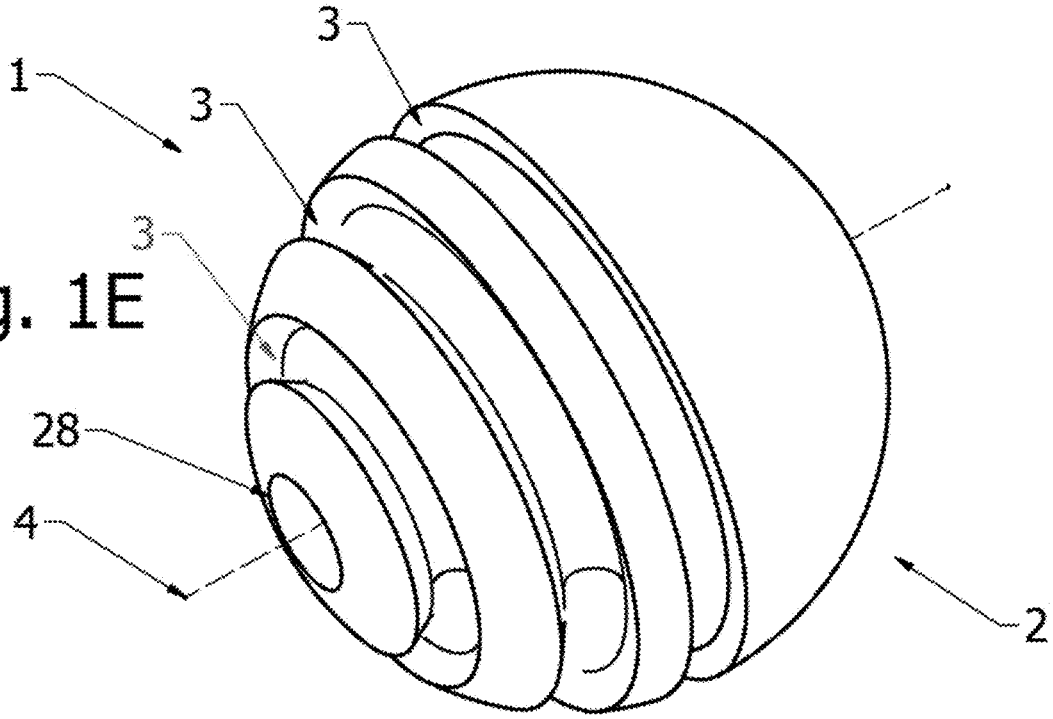

As used here, the following definitions and abbreviations apply.

"Exemplary" (or "e.g." or "by example" or "such as") means a non-limiting example.

"Asymmetrical" means a feature is more prevalent about a first hemisphere of a sports ball of the present invention relative to a second hemisphere of the sports ball, wherein the first hemisphere and the second hemisphere are joined by an equator.

"Coincident", as it refers to two geometries, means that the geometries share at least two points of intersection or overlap. For example, a vector (e.g. a ball's initial trajectory upon projection) and a plane are coincident when the vector lies on the plane. As another example, a vector and an equator (e.g. circle) are coincident when the vector and the equator lie on the same plane.

Overview of the Invention

A ball of the invention comprises a structural feature which controls vertical trajectory of the ball and/or a structural feature which controls horizontal trajectory of the ball.

A structural feature which controls vertical trajectory is configured to, when differentially oriented to interface the drive wheel in a dominant or weaker manner, dictate the vertical component of the ball's trajectory when the ball is projected from the drive wheel. This structural feature is a first portion (e.g. first hemisphere) of the ball surface imparting increased or decreased traction to the ball-wheel interface, relative to a second portion (e.g. second hemisphere) of the ball surface.

A structural feature which controls horizontal trajectory is configured to, when differentially oriented to one side or another (e.g. left or right) of a pitching machine drive wheel, dictate the horizontal component of the ball's trajectory when the ball is projected from the drive wheel.

The structural feature which imparts control of vertical trajectory is optionally the same or partially the same structural feature that imparts control of horizontal trajectory (e.g. grooves).

Accordingly, the horizontal and/or vertical components of the trajectory of a present ball can be dictated at-will by a user, e.g. even without a sophisticated pitching machine depending upon how the user loads the ball to a pitching machine. For example, a standard pitching machine having a single drive wheel can be used to propel a ball of the invention with at least four trajectories (e.g. high, low, left, and right).

Optionally, the invention contemplates a ball that can control both horizontal and vertical trajectory. Optionally, the ball comprises a hemisphere having a structural feature that controls both vertical and horizontal trajectory (e.g. as detailed in Example 1), such as one or more grooves asymmetrically positioned on one hemisphere. Alternatively, the height-controlling structure and the horizontal trajectory controlling feature may be different. Further, the height-controlling structure and the horizontal trajectory controlling feature may be on non-overlapping (i.e. opposite) hemispheres, or on overlapping hemispheres. For example, first and second non-overlapping hemispheres may be provided that are shaped such that they experience different air pressure to control the horizontal trajectory, and third and fourth non-overlapping hemispheres may be provided that impart different on-wheel traction to control the vertical trajectory. The first and second hemispheres may be the same as the third and fourth hemispheres (e.g. as in Example 1), respectively, or the first and second hemispheres may be different than (but overlapping with) the third and fourth hemispheres (e.g. where air pressure differences are imparted by a first surface shape and traction is induced by frictional coating or a second surface shape that still allows the first surface shape to control horizontal trajectory). Optionally, a height-controlling structure is oriented side up or side down on a drive wheel to control vertical trajectory. Optionally, horizontal trajectory structures are oriented on one side or another (e.g. left or right) on a drive wheel to control horizontal trajectory.

Control of Horizontal Trajectory

A ball of the invention optionally comprises a structural feature which controls horizontal trajectory of the ball (sometimes referred to herein as a 'horizontal trajectory controlling structure'). This structural feature is configured to, when differentially oriented laterally to a side or another (e.g. left or right) of a pitching machine drive wheel, dictate the horizontal component of the ball's trajectory when the ball is projected from the drive wheel. Such a horizontal trajectory controlling structure can be provided, e.g. by any asymmetrical ball shape.

The horizontal component of a present ball's trajectory can changed, for example, by imparting a trajectory with a curve or a projection angle offset relative to a normal projection angle (where the normal projection angle is perpendicular to the axis of rotation of a drive wheel).

Optionally, a ball of the invention is configured to curve. In-flight curvature can be imparted by providing a ball shape that creates different air pressure about opposing sides (e.g. left and right sides) of the ball as it travels through the air. Differential air pressure can be imparted, for example, by providing a ball with first and second hemispheres which experience or impart different air speeds adjacent to the ball surface. For example, an increased air speed across a first hemisphere can reduce air pressure about the first hemisphere. Conversely, reduced air speed across a first hemisphere can increase air pressure about the first hemisphere. The speed of air flowing across a hemisphere can be controlled, for example, by providing a hemisphere shape which increases or decrease the length of the path air travels across the hemisphere. Additionally or alternatively, differential air pressure can be imparted by providing first and second hemispheres which impart differential turbulence or vortices and/or differentially modify local boundary layer separation.

Relative to a perfect hemisphere, a first hemisphere of a ball of the invention can be structurally modified to increase or decrease air pressure about the first hemisphere, thus providing a ball which curves away from or towards, respectively, the first hemisphere. For example, U.S. Pat. No. 6,354,970 B1 to Reinke et al. discloses a ball having grooves in one hemisphere, wherein the ball curves towards the hemisphere having the grooves. An example of this ball and curving effect is embodied by the Rawlings® Curveball Trainer, a practice ball thrown by a user. As another example of a curving effect, Titleist® discloses a golf ball having dimples on only one hemisphere, wherein the ball curves towards the hemisphere having the dimples (Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design>). Alternatively, the present inventor has also discovered a ball having one hemisphere with grooves that curves away from the hemisphere with grooves, as detailed in the examples taught herein.

In one embodiment, the ball of the invention comprises a hemisphere with one or more arcuate grooves that are parallel, substantially parallel, or non-perpendicular to an equator that connects the hemisphere with another hemisphere of the ball. Annular grooves are especially useful in the present invention and can optionally be combined with an concave segment removed from one end. Optionally the one or more arcuate grooves comprise a plurality of arcuate grooves that are parallel or substantially parallel to each other (e.g. where the grooves lie on parallel planes or where imaginary tangents of the groove arcs are parallel). For example, the hemisphere can comprises a plurality of arcuate grooves positioned about respective planes that are parallel to each other and/or parallel to a plane comprising the equator (e.g. concentric grooves or grooves encircling the same center axis). The one or more arcuate grooves can fully or partially encircle the ball. As an example of a groove substantially parallel to the plane comprising the equator, the ball can comprise a spiral or helix groove that arcs around the ball as it becomes more distant from the equator. Examples of useful arcuate grooves are disclosed in U.S. Pat. No. 6,354,970 to Reinke et al. and the examples taught herein. According to the present invention, grooves can be configured, for example, to cause the ball to curve or angle away from the grooved hemisphere (e.g. as detailed in the examples taught herein) or towards the grooved hemisphere (e.g. as detailed in U.S. Pat. No. 6,354,970). The characteristics of the one or more grooves such as shape or depth can govern the curving or angling effect. With the teachings provided herein, the skilled artisan can readily produce a ball having such arcuate grooves without undue experimentation.

In one embodiment, the ball of the invention has a segment removed from an end (e.g. pole) of the ball. The removal of a segment can be configured, for example, to leave, at the end of the ball, any of the following: a flat surface, a concave surface, a convex surface, a flat surface with the peripheral edge thereof beveled to meet a balls spherical surface, a flat annular surface surrounding a convex surface, a recessed surface such as a recessed flat surface, a flat annular surface surrounding a concave surface, or a flat surface across which extends a plurality of parallel grooves such as V-shaped or rectangular shaped grooves. Examples of such a removed segments are disclosed by U.S. Pat. No. 4,128,238 to Newcomb et al. and the examples taught herein. Such a structural feature can optionally be configured to cause the ball to curve away from the hemisphere having the structural feature. Without being bound by theory, the inventor believes that this may be due to the creation of a high pressure zone, for example, due to a shorting if an air path that passes the hemisphere having this structural feature. However, the inventor has also discovered that a segment can be removed from a ball to cause curvature towards the hemisphere having the removed segment. Without being bound by theory, the inventor believes that small variations in structure can sometimes have the opposite curving effect depending on whether the air-path effect or the turbulence effect is greater. Without undue experimentation, the skilled artisan can readily produce such features and configure them for a given ball and/or speed at which the ball is intended to be projected.

In one embodiment, a ball of the invention comprises a structure (e.g. grooves, dimples, facets, or inward or outward bumps or other projections) in a first hemisphere which, relative to the second hemisphere, imparts differential turbulence or vortices and/or differentially modifies local boundary layer separation, for example, to decrease air pressure about the first hemisphere. Such structures are sometimes referred to herein as vortex generators or turbulence generators. Indeed, vortex and turbulence generation has been used on the top side of an airplane and dimples have been used on golf balls to "trip" a turbulent boundary layer and increase airspeed (Aerospaceweb, "Vortex Generators", Retrieved from the internet URL:<http://www.aerospaceweb.org/question/aerodynamics/q0009.shtml>, Aerospaceweb, "Golf Ball Dimples & Drag", Retrieved from the internet URL:<http://www.aerospaceweb.org/question/aerodynamics/q0215.shtml, and Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design>). For example, Titleist® discloses a golf ball having dimples on only one hemisphere, wherein the ball curves towards the hemisphere having the dimples (Titleist. "Learning to Fly: Dimples and Golf Ball Design", Retrieved from the internet URL:<http://www.titleist.com/teamtitleist/b/tourblog/archive/2014/12/18/learning-to-fly-dimples-and-golf-ball-design>). With regards to vortex generators or turbulence generators such as dimples, it is known to golf ball manufactures that slight deviations in dimples configuration (e.g. surface density, depth, area, and/or shape) can cause drastic changes in aerodynamics. However, many different dimple (and other generator) configurations are known in the golf ball manufacturing field to create a positive impact on turbulent boundary layer and aerodynamics (e.g. to increase flight distance). Accordingly, with the teachings provided herein, one skilled in the art can, without undue experimentation, readily create vortex generators or turbulence generators to modulate the air pressure difference of two hemispheres of a ball of the invention. An interesting disclosure is that of U.S. Pat. No. 6,354,970 B1 to Reinke et al., discloses a ball having grooves in one hemisphere, wherein the ball curves towards the hemisphere having the grooves. Without being bound by theory, the present inventor believes that, while these grooves may indeed create a shorter air path, which would otherwise contribute to an increase in pressure on the grooved side, the ball of Reinke et al. actually curves towards the grooved hemisphere, presumably due to a more dominant reduction air pressure force created by this particular groove configuration, for example, by the tripping of a turbulent boundary layer. Which effect dominates (e.g. air path distance vs turbulence) can sometimes be governed by the speed the ball is projected. However, a ball of the invention can be configured to be projected at, e.g. 50-70 mph (or even a much larger range of speeds) such as 50, 60, or 70 mph, and curve away from the first hemisphere comprising the grooves when projected at said speed (e.g. as in FIG. 5). This is quite surprising given that some prior art ball configurations only curve in a specified direction depending on the speed at which they are projected.

In one embodiment, a ball of the invention comprises a first hemisphere comprising a vortex or turbulence generator (e.g. dimples) which induces or contributes to in-flight ball curvature towards the first hemisphere and further comprises a second hemisphere a structure (e.g. grooves) which induces or contributes to in-flight ball curvature or lateral trajectory away from the second hemisphere (e.g. grooves). An example of such is detailed in the examples taught herein.

In one embodiment, the ball comprises a hemisphere having a plurality of grooves extending away from an equator that joins the hemisphere with another hemisphere of the ball. Optionally, the ball comprises an arcuate groove positioned coincident with the equator (e.g. a generally equatorial-circumferentially-extending groove). An example of such a structural feature is disclosed in US 2007/0155549 to Keker. Such a structure can be configured to impart curvature towards the hemisphere having the plurality of grooves extending away from an equator. Without being bound by theory, the inventor believes that this effect may be due the action of these grooves as vortex or turbulence generators.

In one embodiment, a ball of the invention comprises a structure, that when oriented laterally to one side of a pitching drive wheel, is projected from the drive wheel with a projection angle offset relative to a normal projection angle (i.e. perpendicular to the axis of rotation of a drive wheel). For example, a first hemisphere can have one or more wheel-interfacing members (e.g. ridge or other projection) that, due to its asymmetrical lateral orientation, cause the ball to be projected at an angle. Without being bound by theory, it is believed that while a drive wheel spins in a direction perpendicular to its axis (thus providing a perpendicular force), the angle of interface or attack on the interfacing members can be configured to be non-perpendicular and causes an angled trajectory of the ball.

Optionally, when projected from a pitching machine at any of 40 mph, 50 mph, 60 mph, or 70 mph (as it departs from a drive wheel) or projected from a from a pitching machine having been set to a setting configured to project a ball at said speed, and the pitching machine being oriented to project the ball horizontally, the ball travels a lateral distance (e.g. left or right relative to center) of at least 3 inches or at least 6 inches relative to center (i.e. relative to a straight-traveling ball not modified according to the present invention), upon having traveled 40 feet horizontally from the pitching machine. For example, the ball can be configured to travel a lateral distance of about 3 inches to about 15 inches (e.g. about 3 inches to about 10 inches, about 6 inches to about 15 inches, or about 6 inches to about 10 inches) upon traveling longitudinally 40 feet Optionally, the pitching used to provide such lateral movement is the Jugs M1200 set on 60 mph and having an appropriately sized ball-loading chute and an appropriately-spaced pinch pad (i.e. configured for the diameter of the ball).

Figure 5A:
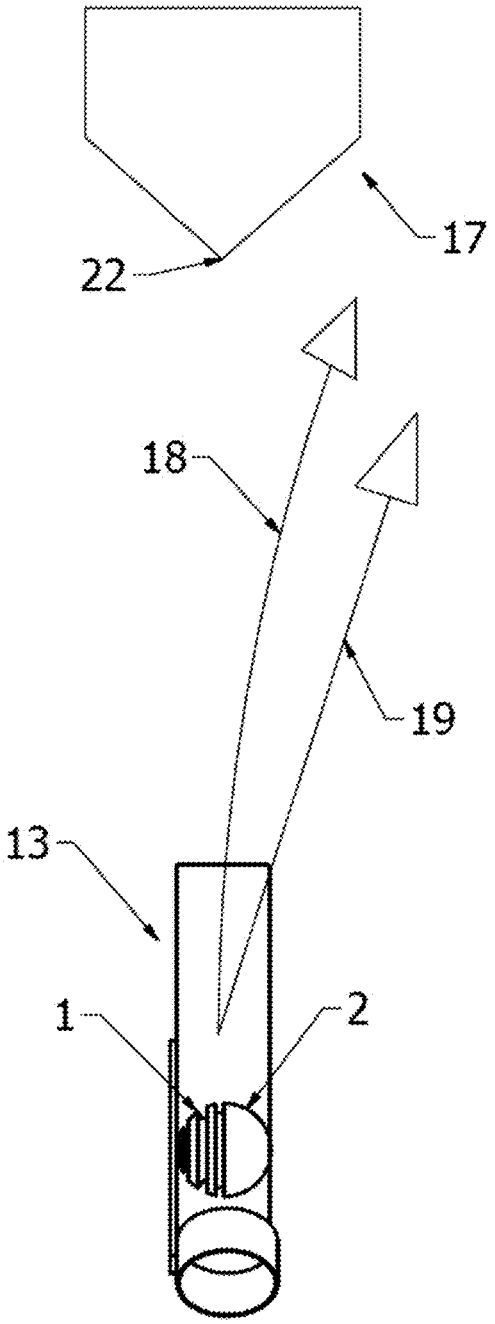
FIGS. 5A and 5B depict the same ball projected from a pitching machine with different horizontal trajectories.
Figure 5B:
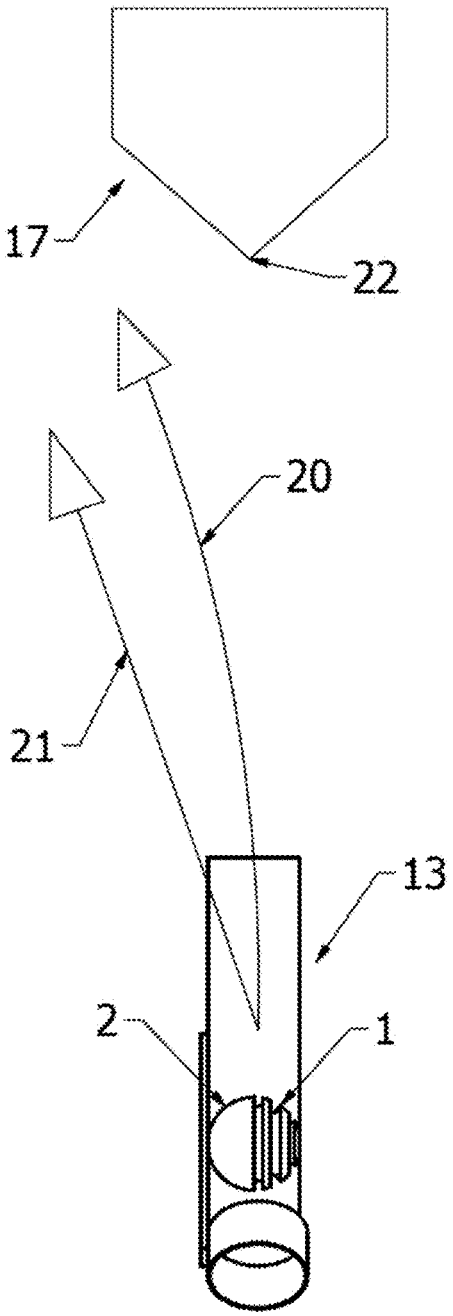

Control of Horizontal Trajectory Away from a First Hemisphere Comprising Grooves As taught herein, a ball of the present invention can comprise a first hemisphere and a second hemisphere (i.e. non non-overlapping (opposing) hemisphere of the ball), wherein the first hemisphere comprises a plurality of grooves, for example, running substantially parallel to the equator that separates the first and second hemisphere. The plurality of grooves are configured such that when the ball is projected from a drive wheel of a pitching machine after being oriented such that the first hemisphere is set laterally to a first side of a center plane of a drive wheel of the pitching machine and the axis of rotation of the ball imparted by the wheel is between the first hemisphere and the second hemisphere (as shown in FIGS. 5A and 5B), the trajectory of the projected ball is offset laterally toward a second side of the center plane opposite the first side (i.e. the trajectory of the ball is away from the grooved side).

This is quite surprising over the prior art ball of U.S. Pat. No. 6,354,970 B1 to Reinke, in which the ball curves towards the grooved side. What's more surprising and especially useful is that balls of the present invention can be made much heavier (high density) than the ball of Reinke, which must be made very light (low density). Thus, balls of the present invention can optionally be made with a density of at least about 0.2 g/cm$^3$ (or even greater such as 0.3-.5 g/cm$^3$) and have controllable horizontal trajectory that mimics the amount of lateral trajectory thrown by an actual baseball or softball pitcher, and has a density that mimics the actual density (feeling on hitting the bat) of a standard baseball or softball.

The plurality of grooves can be configured to provide curvature away from the first hemisphere comprising the grooves. The inventor has discovered that structural features of the grooves play an important role in governing the ability of a ball to curve horizontally away from the grooved hemisphere, such as groove depth, groove shape, groove width, protrusion angle, length of uninterrupted groove, and cumulative arc angle of the a co-linear groove, and presence or absence of a cutoff or concave surface at the pole of the first hemisphere. While tailoring each of these features independently can change (or impart/eliminate) the curving effect, the present inventor has discovered that it is often how these features are provided together that determines whether the ball has acceptable properties. While, in one instance, a given feature may not provide acceptable properties (i.e. curving), the same feature may provide the property when other features are tailored properly. Accordingly, although some features may be described as imparting or eliminating the desired effect, the invention does not altogether disclaim these features as possible configurations of a useful ball, or purport that the feature is enough on its own to provide a useful ball, only that the feature did or did not work in a specific combination with other features (whether or not such other features are specifically noted). The following features are examples of features known to the inventor to be able to affect (or impart) the curving properties of the ball, i.e. whether a ball will exhibit curving away from a grooved hemisphere when projected from the wheel of a pitching machine.

Groove Shape

The inventor has discovered that groove shape plays a role in determining whether a ball can curve away from the first hemisphere comprising the grooves. Several groove shapes were tested for their ability to impart curvature away from the first hemisphere comprising the grooves. In certain the tested configurations, it was found that "U" shaped grooves (e.g. as in FIG. 7). were able to impart curvature while "V" shape (e.g. as in FIG. 9) grooves were not. Specifically, it was found that, at least in these experiments, grooves having a curve at their base (in contrast to a point at the base of V groove), were able to impart the curvature. However, the inventor also discovered that, at least in the tested configurations, groove shape was not alone sufficient to impart the curvature. Specifically, the balls did not exhibit the curvature unless they were cut deep enough, and within a tolerable angle of protrusion, and with a tolerable length of uninterrupted groove. Further, while the invention may not necessarily be limited to "U" grooves, the inventor has discovered that the angle of the relative angle sidewalls of the groove plays a role (i.e. whether groove is tapered to its base or has parallel sidewalls). It has been found that some taper in the sidewalls is tolerable, but that excessive taper can reduce or eliminate the ability of the grooves to impart curvature away from the grooved hemisphere. Moreover, it may also depend on other aspects of the grooves (e.g. as described below). whether or not the ball exhibits the curvature. However, with the teachings provided herein, and without undue experimentation, one skilled in the art can configure a ball of the invention with a groove shape that provides curvature away from the first hemisphere comprising the grooves.

Groove Depth

The inventor has discovered that groove depth plays a role in determining whether a ball can curve away from the first hemisphere comprising the grooves (and whether it has controllable vertical trajectory). Balls were tested that varied only by the depth of the grooves, and deeper grooves generally provided greater curvature away from the grooved hemisphere, and when the grooves are made shallow, it can happen that the grooves actually cause the ball to curve towards the grooved side (and with so little curving effect that no curve is seen unless the ball has a very low density). Moreover, it may also depend on other aspects of the grooves (e.g. as described herein). whether or not the ball exhibits the curvature.

Optionally, the total depth of the groove D is at least 4% of the diameter of the ball, or at least 5% of the diameter of the ball (e.g. and less than 11% of the diameter of the ball), e.g as in Example 14.

Thus, with the teachings provided herein, and without undue experimentation, one skilled in the art can configure a ball of the invention with a groove shape that provides curvature away from the first hemisphere comprising the grooves.

Groove Width

The inventor has discovered that groove width plays a role in determining whether a ball can curve away from the first hemisphere comprising the grooves. Balls were tested that varied only by the width of the grooves, and wider grooves generally provided greater curvature away from the grooved hemisphere, and when the grooves are made very narrow, it can happen that the grooves actually cause the ball to curve towards the grooved side (and with so little curving effect that no curve is seen unless the ball has a very low density). Further, although wider grooves can impart greater curvature away from the grooved hemisphere, wider grooves also results in less inter-groove spacing, which imparts a thin portion ball surface between the grooves, which results in poor longevity of the ball (the inter-groove spacing portion will break apart from hitting with a bat). Further, although the ball may be able to be made with less grooves (which would reduce the curvature) but have grooves of greater width (which would increase curvature), wider grooves can impart a wobble to the ball and can also be visible to the batter at a great distance (when loading into the pitching machine), so the batter can predict which way the ball will curve (this is a negative effect when trying to surprise the batter of curve direction). Moreover, it may also depend on other aspects of the grooves (e.g. as described herein). whether or not the ball exhibits the curvature. Thus, with the teachings provided herein, and without undue experimentation, one skilled in the art can configure a ball of the invention with a groove width that provides curvature away from the first hemisphere comprising the grooves.

Protrusion Angle of Groove

The inventor has discovered that groove protrusion angle plays a role in determining whether a ball can curve away from the first hemisphere comprising the grooves (e.g. the angle of an imaginary line connecting the mouth of the groove to the base of the groove). Balls were tested that varied only by the protrusion angle of the grooves, and protrusion angles that were directed at the center of the ball exhibited greater curvature away from the grooved hemisphere. Moreover, when the protrusion angle was too similar to the angle of the equator that separates the first and second hemisphere (e.g. parallel to the equator), or too different than the ball radius angle measured at the groove, the ball did not exhibit any curvature away from the grooved hemisphere (e.g. as in FIG. 8). Further, although protrusion angles that were directed at the center of the ball are preferred for the sake of curvature (e.g. as shown in FIGS. 7 and 10-12), it was discovered that these balls were unable to be removed from a steel (rigid) mold consisting of two halves after injection molding. Thus, it was attempted to make the protrusion angles of all grooves parallel to each other (and parallel to the equator, as in FIG. 8) so that the mold could be disassembled without damaging the surface of the ball; however, this ball, even with groove depth that was previously deemed appropriate, did not exhibit the curving properties. Thus, balls with acceptable protrusion angle can optionally be made using a silicone mold (which is flexible and can bend around the grooves when disassembling the mold) or can be by a lathing process (molding a ball without the grooves and then cutting the grooves by lathe). Accordingly, one embodiment of the invention provides a flexible (e.g. silicone) mold that comprises an inverse structure of the first hemisphere of a ball of the invention (e.g. the inverse of the ball of FIG. 7 with a void in place of the structure of FIG. 7), wherein the ball has grooves with a protrusion angle that is non-parallel to the equator (e.g. a small dRA,C such as zero).

Moreover, it may also depend on other aspects of the grooves (e.g. as described herein). whether or not the ball exhibits the curvature. Thus, with the teachings provided herein, and without undue experimentation, one skilled in the art can configure a ball of the invention with a groove protrusion angle that provides curvature away from the first hemisphere comprising the grooves.

Length of Uninterrupted Groove

A useful groove may be interrupted by a non-grooved portion of the ball surface, such that the groove is broken into a plurality of collinear sub-grooves (i.e. grooves lying on the same imaginary arc). However, the inventor has discovered that length of uninterrupted groove plays a role in determining whether a ball can curve away from the first hemisphere comprising the grooves. For example, although a groove useful in the invention may be interrupted (i.e. broken up) into portions of the groove along the same arc (i.e. interrupted by non-grooved surface), the inventor has discovered that, for example, a plurality of collinear shallow dimples (i.e. dimples lying along the same arc, as in U.S. Pat. No. 6,837,814) did not provide the desired curving effect in a tested ball. In fact, this ball induced a very slight curvature towards the dimpled hemisphere (as is consistent with the teaching taught herein for dimpled balls). Thus, at least in some configurations, ratio of groove length (i.e. interrupted groove length) to width of 1:1 did not provide curvature away from the grooved hemisphere (when projected from a pitching machine after being oriented such that the first hemisphere is set laterally to a first side of a center plane of a drive wheel of the pitching machine such that an axis of rotation of the ball extends from the first hemisphere to the second hemisphere). While the inventor has not demonstrated the precise cutoff of length of uninterrupted groove, the inventor believes that grooves can be configured as elongated uninterrupted grooves, e.g. with an length (taken from the surface of the ball) of at least twice the width of the groove (taken from the surface of the ball), i.e. at least a 2:1 ratio of length to width. Optionally, the ratio of uninterrupted length to width of the grooves is at least 3:1, at least 4:1, at least 5:1, at least 6:1, at least 7:1, at least 8:1, at least 9:1, or at least 10:1. Additionally or alternatively, the ratio of uninterrupted length to depth of the grooves is at least 3:1, at least 4:1, at least 5:1, at least 6:1, at least 7:1, at least 8:1, at least 9:1, or at least 10:1.

Moreover, it may also depend on other aspects of the grooves (e.g. as described below). whether or not the ball exhibits the curvature. Thus, with the teachings provided herein, and without undue experimentation, one skilled in the art can configure a ball of the invention with a groove uninterrupted length that provides curvature away from the first hemisphere comprising the grooves.

Cumulative Arc Angle

As discussed above, a groove may be interrupted by non-grooved portion of the surface into a plurality of collinear sub-grooves (i.e. grooves lying on the same imaginary arc). However, the inventor has discovered that, in addition to the uninterrupted length of the each of the sub-grooves, the cumulative arc angle (of all the sub-grooves of the same imaginary arc) plays a role in determining whether a ball can curve away from the first hemisphere comprising the grooves. For example, it was determined that, the greater the cumulative arc angle of a groove, the greater the curving effect that was imparted by the groove. While a 100% (360 degree) cumulative arc angle (no interruptions) provided the greatest curving effect, a 75% cumulative arc angle (270 degrees) provided substantial, albeit less curving than a 360 cumulative arc angle, and a 50% cumulative arc angle (180 degrees) provided a slight curving effect (3 inches or less at 60 mph over 40 feet), and a 25% cumulative arc angle (90 degrees) provided no observable curving effect.

Moreover, it may also depend on other aspects of the grooves (e.g. as described herein) whether or not the ball exhibits the curvature. Thus, with the teachings provided herein, and without undue experimentation, one skilled in the art can configure a ball of the invention with a groove cumulative arc angle that provides curvature away from the first hemisphere comprising the grooves.

Angle of a Sidewall Portion

The inventor has discovered that sidewall protrusion angle plays a role in determining whether a ball can curve away from the first hemisphere comprising the grooves (e.g. the angle of an imaginary line connecting the mouth of the groove to the base of the groove). In addition to the protrusion angle of the groove, it has been discovered that sidewalls which are substantially parallel to (or less than a tolerable angle difference) each other and/or are projected to the center of the ball (a dRA,SW of zero or less than a tolerable amount such as, e.g. less than 15 or 20 degrees) generally provide the desired curving effect when combined with other acceptable features of the invention. The sidewall portion used for such a measurement can be, e.g. a sidewall portion that is at least 50% of the depth of the groove (i.e. the entire sidewall portion is within said angle relative to the radius and/or same sidewall portion of the opposing sidewall), e.g. at least 50% of the sidewall of a groove is parallel or less than about 20 degrees difference relative at least 50% of the opposing sidewall of the groove (i.e. a dSW1, SW2 being zero or less than 20 degrees for a Dsw representing 50% of the groove depth), and/or at least 50% of each of the sidewalls of a groove are less than tolerable angle difference than the radius measured at the respective sidewalls (e.g. dRA, SW1 and dRA,SW2 each less than 20 degrees).

Moreover, it may also depend on other aspects of the grooves (e.g. as described below). whether or not the ball exhibits the curvature. Thus, with the teachings provided herein, and without undue experimentation, one skilled in the art can configure a ball of the invention with sidewall portion of sufficient length (e.g. a Dsw of 5 mm for a 12 inch ball) that is within an angle, relative to the opposing sidewall portion and/or radius to provide curvature away from the first hemisphere comprising the grooves.

Optionally, when projected from a pitching machine at 60 mph (as it departs from a drive wheel Control of Vertical Trajectory A ball of the invention optionally comprises a structural feature which controls vertical trajectory of the ball ('height-controlling structure'). This height-controlling structure is configured to, when differentially oriented to interface the drive wheel in a dominant or weaker manner, dictate the vertical component of the ball's trajectory when the ball is projected from the drive wheel. This structural feature is provided by a first portion of the ball surface imparting increased or decreased traction or grip to the ball-wheel interface and/or a ball-pinch plate interface (e.g. as detailed in Example 3), relative to a second portion of the ball surface. Accordingly, a ball of the invention optionally comprises a surface with a plurality of portions exhibiting different traction on a drive wheel.

The Magnus effect is an effect in which a spinning ball curves away from its flight path due to the rotation of the ball. The Magnus effect imparts force on the ball which is perpendicular to both the flight path and the axis of rotation. Under the Magnus effect, backspin imparts an upward force (opposite that of gravity) on a moving ball, while topspin produces a downward force (in the same direction as gravity). Standard pitching machines optionally have a single drive wheel that spins on a horizontal axis and creates backspin on ball projected from the top of the wheel. The amount of upward force imparted by the Magnus effect is governed by the speed (RPM) at which the ball spins as it is projected from the drive wheel. Therefore, at a fixed air speed, whether the ball actually rises from the Magnus effect (or the extent thereof), or merely experiences less of a drop due to gravity (or the extent thereof), can also be governed by the rate of backspin imparted by the drive wheel and the weight of the ball.

The present inventor has discovered that the rate of spin imparted on a ball when being projected by a pitching machine having a drive wheel can be manipulated by changing the traction of the ball-wheel interface and/or a ball-pinch plate interface. The present inventor further discovered that a ball having a plurality portions (e.g. first and second hemispheres) exhibiting different traction can be propelled with different rates of spin, depending on which of the plurality of ball portions dominates the ball-wheel interaction (and/or ball-pinch plate interaction) as the ball is propelled from the wheel. Accordingly, a ball having a height-controlling structure can be projected from a pitching machine to provide at least two modes of projection, namely, a high ball (e.g. with greater backspin) and a low ball (e.g. with less backspin). These modes can be, for example, differentiated by whether the height-controlling structure dominates the ball-wheel interface when being projected form the pitching machine. The terms high ball and low ball, as they relate to height, relate to the relative height of the ball after it has been projected a distance (e.g. 30-80 feet) from the pitching machine in the high ball and low ball modes.

Figure 3A:
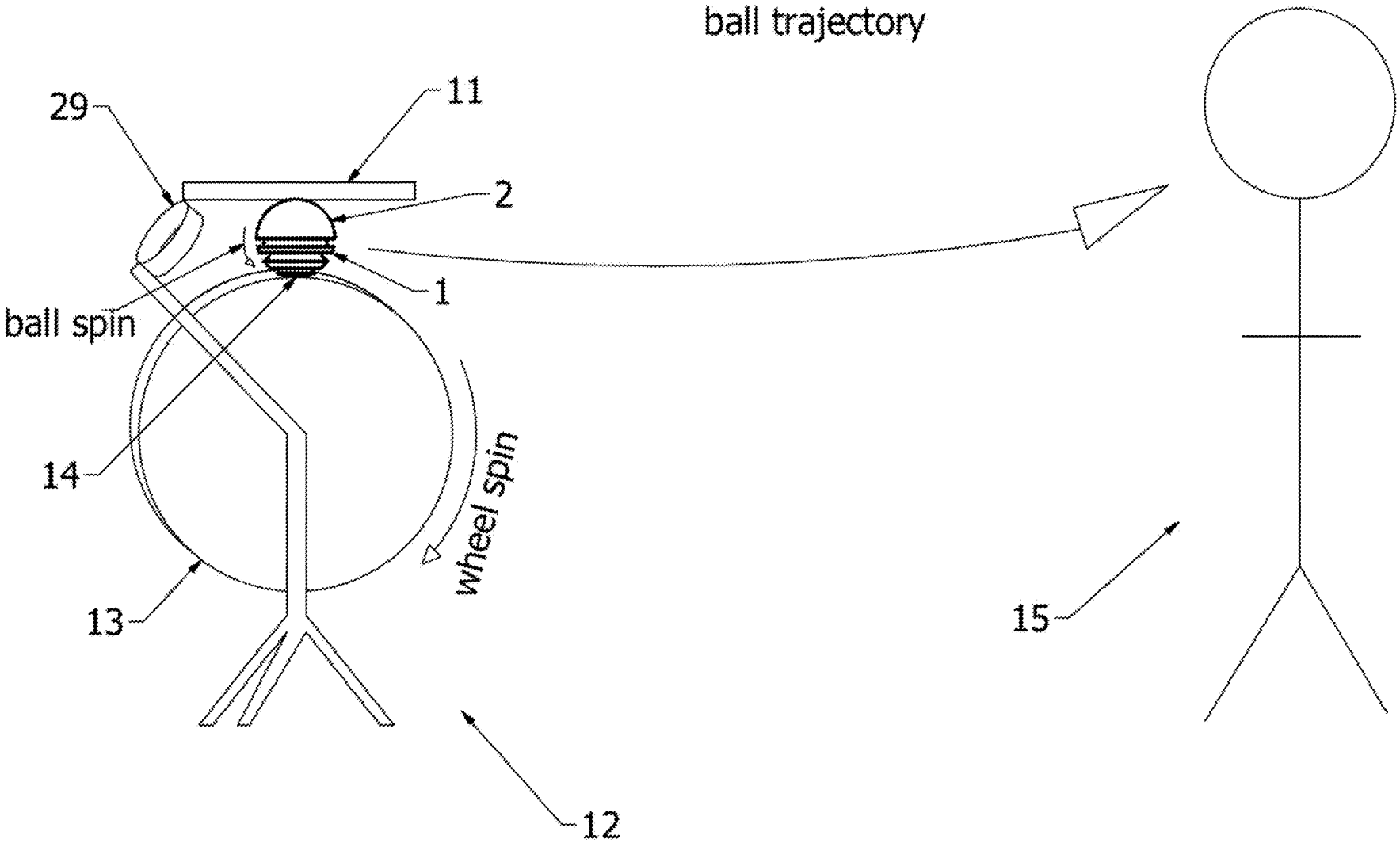
FIGS. 3A and 3B depict the same ball projected from a pitching machine with different vertical trajectories.
Figure 3B:
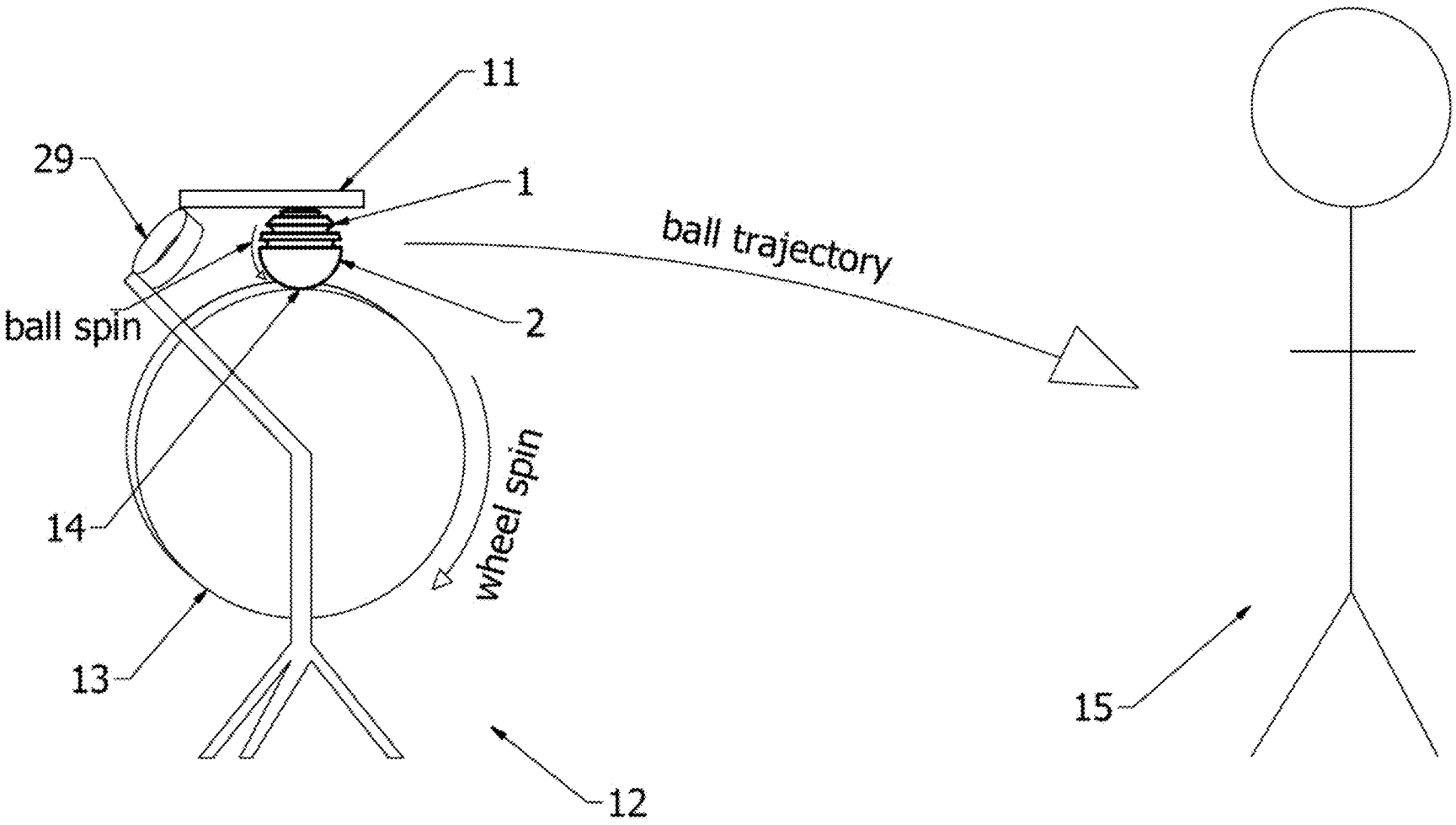

Optionally, a ball of the invention can be projected from a pitching machine in a high ball mode (e.g. as shown in FIG. 3A) and a low ball mode (e.g. as shown in FIG. 3B), wherein when projected from a pitching machine at 60 mph (as it departs from a drive wheel) or projected from a from a pitching machine having been set to project a ball at 60 pmh, wherein the pitching machine is oriented horizontally, the height difference of the ball is, upon having traveled 40 feet horizontally from the pitching machine, at least 10 inches when comparing the ball projected in the high ball mode to the ball projected in the low ball mode. Optionally, the height difference is about 10 inches to about 50 inches. Optionally, the pitching used to provide such a height difference is the Jugs® M1200 set on 60 mph and having an appropriately sized ball-loading chute and an appropriately-spaced pinch pad (i.e. configured for the diameter of the ball). The difference in height between the high ball mode and the low ball mode can be tailored by changing the relative amount of traction (e.g. groove depth) of the two hemispheres and/or changing the relative mass of the two hemispheres.

Optionally, a ball of the invention can be projected from a pitching machine in a high ball mode and a low ball mode, wherein the drop of the ball of the invention in the low mode is greater than that of a comparator ball having uniform weight and shape (e.g. as detailed in Example 9). Optionally, the hemisphere exhibiting increased traction has a different mass than the hemisphere exhibiting decreased traction (e.g. where differential traction is imparted by removal or addition of material relative to the comparator ball). Such a ball optionally exhibits wobble when spinning about an axis that is coincident with an equator that joins the two hemispheres. Additionally or alternatively, this increase in drop can optionally be attributed to the hemisphere exhibiting increased traction providing more grip to interface a pinch plate of a pitching machine, and thereby cause slippage at the wheel-ball interface (on the opposing side of the ball) to reduce backspin and thereby reduce drop-reducing Magnus effect.

The plurality of ball surface portions with different traction can be provided in any manner such that the portions exhibit different grip or friction at the ball-wheel interface and/or at a ball-pinch plate interface. Traction can be tailored with or without a relative change in material composition of the ball's surface at the different portions. By example, the traction may be tailored by configuring the shape of the surface alone or by a change in surface composition (e.g. surface material). For example, traction can be tailored using inward projections such as cavities (e.g. dimples) or tread (e.g. grooves) or outward projections such as outward ridges. Additionally or alternatively, traction can be tailored using a change in surface composition, e.g. a frictional coating (e.g. an elastomer such as rubber or a tack surface or adhesive) or a lubricating coating (e.g. solid such as non-stick coating such as polytetrafluoroetheylene (PTFE) or other non-stick organic polymer, silicon dioxide or other inorganic non-stick material, or a liquid such an oil).

While the invention contemplates balls with any means of providing portions (e.g. hemispheres) with different traction, the present inventor has discovered that traction can be modified by surface shape (e.g. by providing grooves or other traction-imparting surface shapes), even without a differential use of surface materials. This embodiment provides an advantage of having less manufacturing cost of goods (e.g. producible from a mold or a single material), production time (e.g. requiring a reduced number of material types), or production complexity (e.g. being easily sourced to a manufacturer).

Optionally, a hemisphere of a ball can have its surface shape modified to increase or decrease traction. The selection of surface shape and effect on traction can optionally be dependent on physical properties of the ball such as hardness or compressibility. For example, optionally depending upon the ball's weight, the surface of a ball that is extremely hard or non-compressible (e.g. hard plastic balls like a Wiffle ball) may have its traction decreased by the modification with grooves due to the removal of drive wheel-contacting surface. However, the present inventor has surprisingly discovered that the surface of balls having a lower hardness or greater compressibility can have its traction increased by the modification of grooves, which can act as teeth to be gripped by a drive wheel. Further, a ball with extremely low hardness or extremely high compressibility (e.g. the Rawlings® Curveball Trainer or Easton EZ Curve®) can be so "squishy" that surface shape has no effect on traction with a wheel. Accordingly, with the teachings provided herein, and without undue experimentation, the skilled artisan can readily produce a ball having hemispheres or portions with different spin-inducing traction by tailoring hardness, weight or density, and surface shape (or other traction imparting structure).

Further, while the invention contemplates balls having a different means of controlling vertical trajectory than the means of controlling horizontal trajectory, the present inventor has discovered that a surface shape (e.g. grooves) can be used to control both the vertical trajectory and the horizontal trajectory. This embodiment provides an advantage of having less manufacturing cost and complexity and enhancing user-friendliness of the ball of the invention. For example, providing a single feature that controls vertical trajectory and the horizontal trajectory shortens user training time and reduces user error when using the ball (e.g. regarding how to orient the ball about a pitching machine to obtain the desired pitch trajectory).

Optionally, a ball with controllable vertical trajectory demonstrates a relative height difference (e.g. between a high ball as in FIG. 3A and a low ball as in FIG. 3B) of greater than a specified amount after it travels 40 fee, e.g. when projected from a single wheeled pitching machine (e.g. Jugs M1200) at a horizontal initial projection angle at 60 mph. The specified amount can be 15 inches (i.e. the high ball is 15 inches higher than the low ball), 20 inches, 25 inches, 30 inches, or even greater. Surprisingly, the highball mode can actually cause a higher trajectory than a horizontally pitched fast ball (i.e. a normal pitching machine ball having the same density and hardness as the inventive ball)

Other Features

Drag-Reducing Surface

In one embodiment, a ball of the invention comprises a drag-reducing surface. For example, the ball can comprise a plurality of dimples or facets. While such a surface can be imparted asymmetrically to modulate horizontal trajectory (e.g. through curvature-inducing turbulence) or vertical trajectory (e.g. through modulated spin-inducing traction) as taught herein, such a surface can additionally or alternatively be configured to reduce drag and increase projection distance and/or velocity, especially nearing the end of the ball's flight. In other words, a ball can be configured with less drag to undergo less deceleration in-flight.

The mechanism of drag reduction by surface modification is well-known (Choi et al., "Mechanism of drag reduction by dimples on a sphere", Phys. Fluids 18, 041702, 2006, Retrieved online from the URL<http://biosport.ucdavis.edu/lab-meetings/Choi%20et%20al%20-%202006%20-%20Mechanism %20of%20drag%20reduction%-20by%20dimples%20on%20a%20sphere.pdf>).

Optionally, the surface of a ball of the invention comprises a plurality of dimples configured to interrupt laminar air flow over the surface of the ball in flight and induce turbulent air flow. The result of this induced turbulence is reduced drag on the ball, which allows the ball to decelerate slower and be projected with greater precision. Optionally, the dimples are provided in a regular pattern. Optionally, the dimples are semi-spherical in shape. Optionally, the dimples have a diameter or width between 0.10 and 0.5 inches. Optionally, the dimples have a depth of between about 0.03 and 0.1 inches. Optionally, the dimples have a radius of curvature of between 0.02 and 0.15 inches. Optionally, the ratio of the diameter of the ball to the diameter of the dimples is between about 10:1 and 50:1 (e.g. between about 20:1 and 40:1).

Optionally, the ball can comprise a first hemisphere comprising a plurality of grooves, wherein the plurality of grooves are spaced apart from each other (as shown in the drawings), and wherein the spaces between the grooves comprises a plurality of dimples. The inventor has discovered that, although dimples can reduce drag, when dimples are provided in the region between the grooves (or when depth of dimples in the inter-groove spacing is increased relative to shallower dimples), the amount horizontal curvature imparted by the grooves is reduced. It has been found, however, that the initial curvature of the ball can be re-imparted by increasing the depth of the grooves (as discussed in an example taught herein). Without being bound by theory, the inventor believes that such a phenomenon may be occurring due to increased turbulence imparted by the dimples, which disrupts the air flow-grooves interaction that otherwise induces horizontal curvature. Accordingly, while other surface features such as dimples may impact the curve-inducing effect of the grooves, one skilled in the art can configure the grooves (e.g. change the groove depth and/or width) to provide desired curvature.

Physical Properties

A ball of the invention can be made of any material and can have any density, compressibility, hardness, or size.

While the invention is not limited to any particular configuration, the trajectory of a ball of the invention, when projected from a pitching machine, is highly governed by its physical characteristics. For example, the ball disclosed by U.S. Pat. No. 6,354,970 B1 to Reinke et al. and embodied by the Rawlings® Curveball Trainer (Baseballexpress. "Rawlings Curve Ball Hit Training Set (6 Pack)", Retrieved online from the URL<http://www.baseballexpress.com/catalog/product.jsp?product)d=119936>.), fails to produce a satisfactory trajectory when projected from a pitching machine, as detailed in the Examples taught herein. For any ball to be sufficiently projected from a pitching machine wheel, it must have a sufficient weight and hardness or compressibility. However, it has been discovered that, for a ball of the invention having a controllable trajectory, a ball's physical properties (e.g. weight, density, hardness) can be tailored to allow proper interaction with the drive wheel to control the balls trajectory.

A ball with a vertical trajectory can be configured with a sufficient hardness to allow the first and second hemispheres (one of which is specialized to impart greater grip on the wheel) to exhibit differential grip on the wheel. For example, a ball that is too conformable or "spongy" may exhibit so much grip on the drive wheel, that the difference in grip on the wheel from the first and second hemispheres is insufficient to cause a relative difference in spin rate that is great enough to impart a user's desired difference in vertical trajectory when the first and second hemispheres are placed side up or side down on the drive wheel. Further, such squishy balls may not experience sufficient force by a pinch plate to be gripped and projected satisfactorily by the drive wheel. A skilled artisan may tailor hardness to their choosing to provide controlled trajectories according to the present invention, and with the teachings provided herein, will understand that in certain configurations, they may tailor hardness according to the size of the ball or the selection of surface configuration used to impart differential vertical trajectory.

Hardness and Compressibility

Optionally, a ball of the invention is configured with a particular compressibility. Compressibility is the deflection that a ball undergoes when subjected to a compressive load. Compression can be expressed as the force required to compress the ball 0.25 inches. For example, a ball of the invention can optionally have a compressibility of less than about 250 lbs/0.25 in, less than about 200 lbs/0.25 in, less than about 150 lbs/0.25 in, or less than about 150 lbs/0.25 in. By comparison, official baseball and softball game balls have compressibility exceeding 250 lbs/0.25 in. Optionally, a ball of the invention has a compressibility of greater than 5 lbs/0.25 in, for example, greater than 5 lbs/0.25 in and less than any of about 250 lbs/0.25 in, about 200 lbs/0.25 in, about 150 lbs/0.25 in, or about 100 lbs/0.25 in. Optionally, a ball of the invention has a compressibility of greater than 10 lbs/0.25 in, for example, greater than 10 lbs/0.25 in and less than any of about 250 lbs/0.25 in, about 200 lbs/0.25 in, about 150 lbs/0.25 in, or about 100 lbs/0.25 in. Optionally, a ball of the invention has a compressibility of greater than 15 lbs/0.25 in, for example, greater than 15 lbs/0.25 in and less than any of about 250 lbs/0.25 in, about 200 lbs/0.25 in, about 150 lbs/0.25 in, or about 100 lbs/0.25 in. Competition baseballs and softballs are typically characterized by the applied weight required to compress the ball 0.25 inches. While balls of the invention can optionally be substantially more compressible than these competition balls, the compressibility can be measured using the same technique which is well-known.

Optionally, a ball of the invention is configured with a particular hardness. Hardness can be measured by the A-2

Shore durometer scale. Optionally, a ball of the invention has a hardness of at least about 20 or at least about 30 or at least about 40 or at least about 50, for example between about 30 and 100, for example from about 50 and to about 90, from about 60 to about 90, or from about 70 to about 90.

The modification of a ball's surface (e.g. with grooves) can affect the measured values of hardness and compressibility when the measuring tool interacts with the ball at a location in which it is modified (e.g. a ball can be more compressible at a groove). Accordingly, when a ball of the invention has a surface shape is modified (e.g. relative to a perfect sphere), the hardness and compressibility can optionally be measured using a comparator ball not having its surface shape modified but being made of the same composition. Alternatively, the hardness and compressibility can be measured on the ball directly. Thus, the invention contemplates balls having hardness and compressibility taught herein values as measured according to the composition (e.g. material) of the ball itself (i.e. measured using an unmodified comparator ball having the same composition). Further, the invention also invention contemplates alternatively balls having hardness and compressibility taught herein values as measured directly using the ball of the invention.

Density

A ball of the invention can have any density.

Generally, a ball having controllable horizontal trajectory by curving will exhibit less curvature as the density of the ball increase. Accordingly, prior art balls having curve-inducing features have been specifically engineered to have a low density (e.g. about 0.1 g/cm$^3$). However, as taught herein, a ball of the invention is optionally provided as a pitching machine ball having a sufficient weight to be satisfactorily projected from a pitching machine. Surprisingly, such denser balls, when provided with a structure for controlling horizontal trajectory based on in-flight curvature and/or projection angle, can still provide sufficient lateral movement when projected by a pitching machine. While the amount of curvature is reduced as density increases, the precision of a pitching machine, lacked by an average human thrower, can capitalize on even the smallest amount of curvature, as detailed in the examples taught herein. In contrast, the relatively low precision of an average human thrower can ultimately lead to a scenario where the lack of throwing precision accounts for greater deviation in lateral trajectory than curvature imparted by ball structure. Thus, denser curving balls are not only absent in the prior art curving balls, but are contraindicated.

Optionally, the ball has a density of at least about 0.2 grams per cubic centimeter (g/cm$^3$). Optionally, the ball has a density of at least about 0.25 g/cm$^3$. Optionally, the ball has a density of at least about 0.3 g/cm$^3$. Optionally, the ball has a density of about 0.2 g/cm$^3$ to about 1.3 g/cm$^3$, about 0.2 g/cm$^3$ to about 1 g/cm$^3$, about 0.2 g/cm$^3$ to about 0.8 g/cm$^3$, about 0.2 g/cm$^3$ to about 0.7 g/cm$^3$, or about 0.3 g/cm$^3$ to about 0.9 g/cm$^3$.

According to the present invention the density can be measured with respect to the volume displaced by the ball. In other words, if the ball has a hollow core surrounded by layer, the void volume of the hollow core is not subtracted from the volume displaced by the ball to determine density.

Size

A ball of the invention can be any size.

Optionally, the ball has a circumference of about 9 inches to about 16 inches. For example, optionally, the ball has circumference of any of about 9 inches, about 10 inches, about 11 inches, or about 12 inches.

The size of the ball can be measured without considering any cutouts (e.g. grooves or dimples) or projections extending therefrom. In other words, the size of the ball can be measured with respect to the size of a sphere from which the ball is based on before modification (regardless of whether the modification be in the form of molding or assembly).

Materials

A ball of the invention can be made of any material.

Optionally, the ball is made from a polymeric foam such as a polyurethane.

Optionally, the ball uniform density throughout its cross-section.

Optionally, the ball is made from a mold. Optionally, the entirety of the ball or a hemisphere thereof is made from a mold.

Optionally, the ball comprises a resilient polyurethane foam sphere of homogeneous composition and density throughout its cross section.

Optionally, the ball comprises a homogeneous elastomeric material, so that the body has a constant density and hardness (e.g. durometer) throughout.

Optionally, the ball has a non-perforated outer surface. This configuration distinguishes such a ball from wiffle-type balls.

Methods

In one embodiment, the invention provides a method comprising using a ball of the invention in conjunction with a pitching machine configured to project the ball.

Optionally, ball comprises a height-controlling structure and the method comprises orienting the sports ball on a drive wheel of the pitching machine such that the drive wheel-ball projecting interaction is dominated by a first hemisphere having a relatively more tractive surface compared to a second hemisphere, whereby the sports ball is projected with a rate of spin greater than when the sports ball is oriented on the drive wheel such that the drive wheel-ball projecting interaction is dominated by a second hemisphere.

Typical drive wheels produce back spin on the ball. Under this scenario, the ball, when projected with a greater spin, will have a higher trajectory relative to the ball when projected with less spin. The dominating interaction is the wheel-ball interaction which dictates how much spin is produced. For example, the dominating wheel-ball interaction can be the on-wheel interaction provided by last portion of the ball to contact the wheel and/or the portion of the ball that has the longest cumulative contact time with the wheel. For example, depending on the location at which the ball first makes contact with the drive wheel, the ball may rotate one or more times while in contact with the drive wheel before disengaging from the drive wheel to begin its in-flight trajectory. Thus, a user, with only a few test pitches, can quickly compare loading positions and determine how to orient the ball to provide the tractive surface as the dominating wheel-ball interaction.

Optionally, the ball comprises a lateral trajectory-controlling structure and two hemispheres which experience different air pressure when in-flight, and the method comprising orienting the sports ball to offset one of the hemispheres laterally to a first side a center plane of a drive wheel of the pitching machine, whereby the ball of the invention is projected about a trajectory offset laterally relative to when the sports ball is oriented to offset the hemisphere laterally to a second side a center plane of the drive wheel.

EXAMPLES

Example 1 Ball of the Invention

FIG. 1A depicts a useful ball of the invention. The ball comprises a first hemisphere 1 and a second hemisphere 2.

The first hemisphere 1 comprises a plurality (e.g. 3) of arcuate grooves 3 (with sidewalls 5, 6) positioned about respective positions. At the surface of the ball, the groove surface edges are parallel to each other (the edges of respective grooves are annular rings laying on parallel planes which are parallel to a plane comprising the equator that joins the first hemisphere 1 and the second hemisphere 2). It is noted that, unless specifically stated, the terms plane, equator, axis, and pole are imaginary reference geometries and are not meant to indicate that the ball includes an additional structure providing the geometry.

Figure 1F:
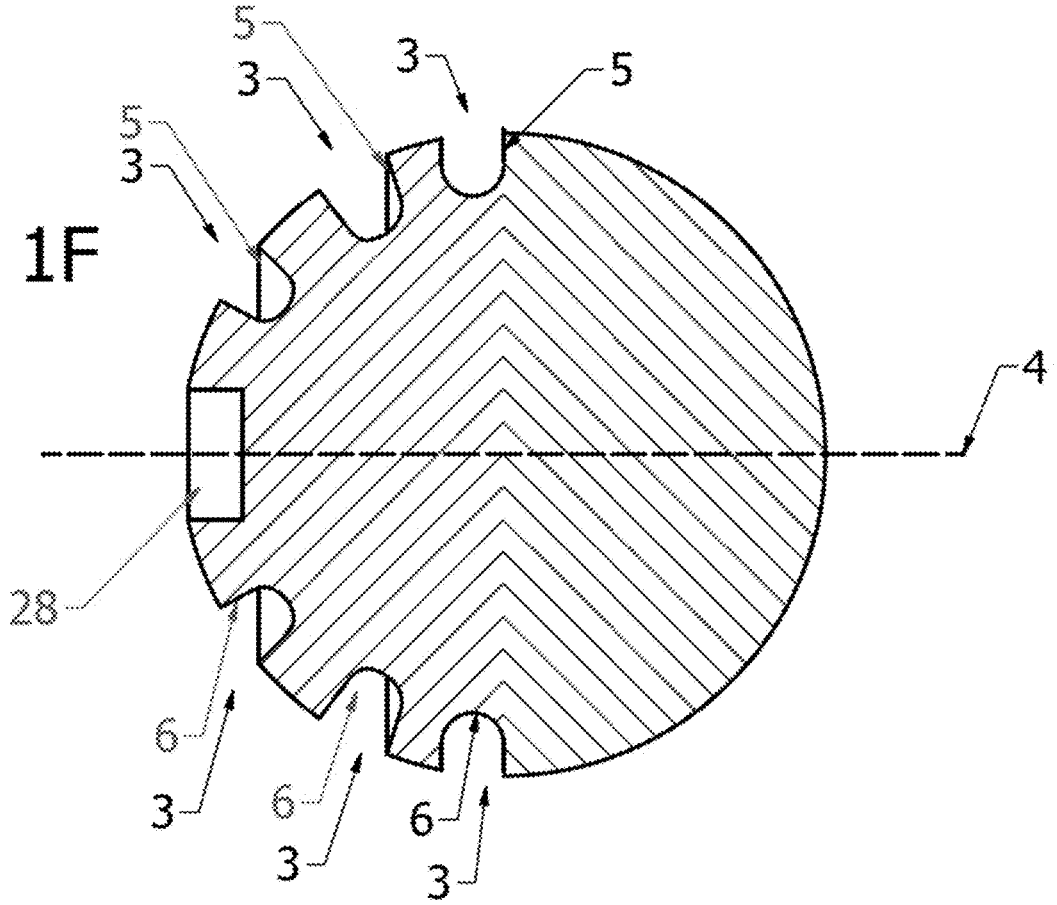
Figure 1G:
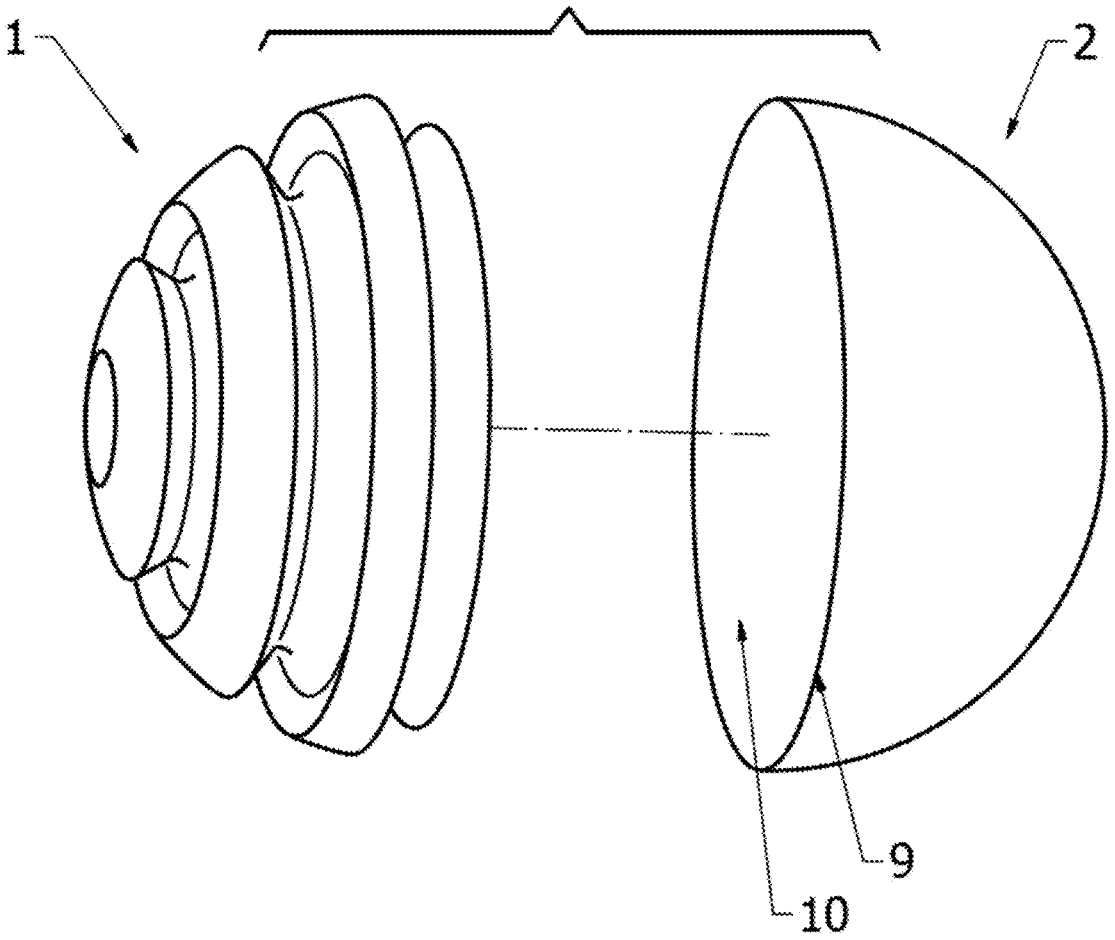
Figure 2:
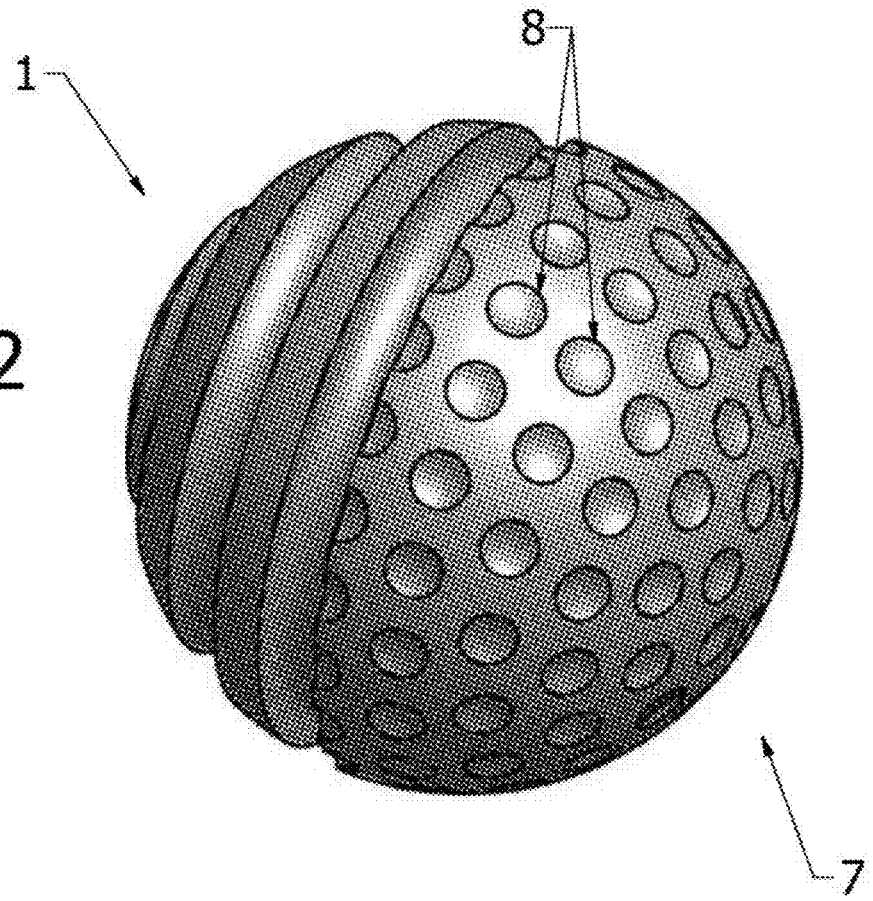
FIG. 2 depicts a ball of the invention.
Figure 10:
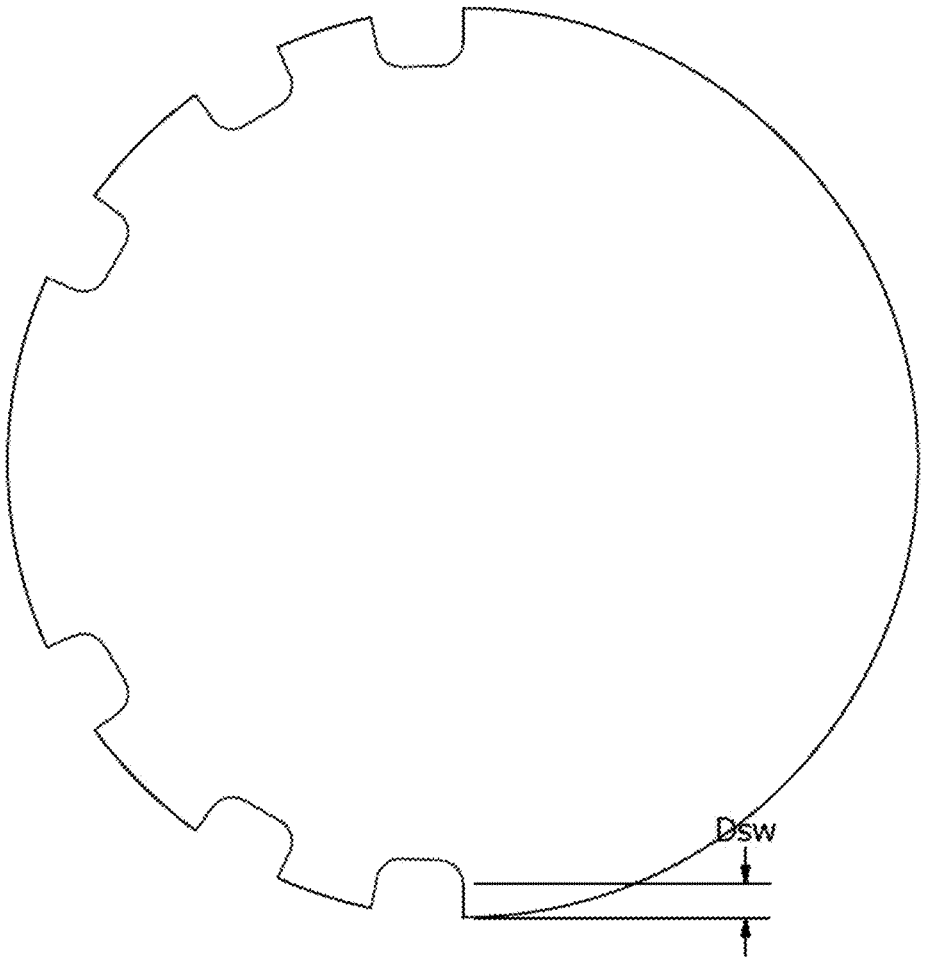
FIGS. 10-12 depict cross sections of balls of the invention.

Each of the arcuate grooves 3 completely surround the ball, as shown in FIG. 10, and have a "U" shape, as shown in FIG. 1F.

The ball further comprises a cut segment 28 having a concave surface.

The ball can comprise an unmodified (e.g. purely hemispherical) second hemisphere 2 as shown in FIG. 1, or it can comprise a second hemisphere 7 having a plurality of dimples 8 or other vortex or turbulence generators.

The grooves of the first hemisphere 1 impart first hemisphere 1 with greater traction on the drive wheel of a pitching machine relative to the second hemisphere 2 and relative to second hemisphere 7. Thus, the ball can be differentially loaded in a pitching machine to impart different amounts of spin to the ball when projected from the pitching machine and thereby control the vertical trajectory, e.g. as detailed in the following example.

The grooves of the first hemisphere 1, when projected in a direction coincident with a plane that connects the first hemisphere 1 and the second hemisphere 2 or 7 (i.e. spinning on an axis that connects the pole of hemisphere 1 with the pole of hemisphere 2 or 7) are configured to induce a high pressure zone about the first hemisphere 1 relative to second hemisphere 2 or second hemisphere 7. Thus, the ball can be differentially loaded (e.g. with hemisphere 1 to the right or the left) in a pitching machine to control the horizontal trajectory of the ball.

Example 2 Method of Projecting a Ball of the Invention with Controlled Horizontal Trajectory A ball of the invention comprising a horizontal trajectory controlling structure can be projected from a pitching machine, wherein the user can control horizontal trajectory, e.g. depending upon how the structure is oriented when the ball is loaded in a pitching machine.

Figure 4:
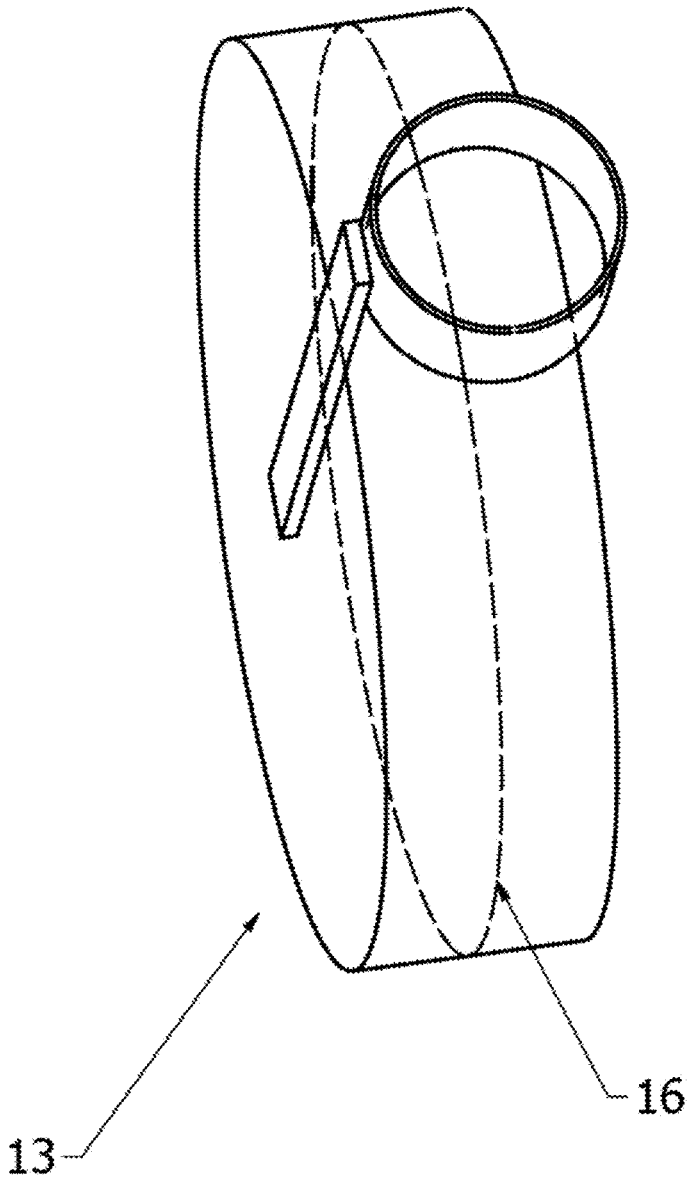
FIG. 4 depicts a pitching machine drive wheel and imaginary center plane thereof.

As shown in FIG. 4, a pitching machine can have a drive wheel 13 that spins about an axis to generate a projecting force. For reference, the drive wheel can be imagined as having a center plane 16.

As detailed in FIG. 5A and FIG. 5B, depending upon how the ball is oriented, the pitching machine will project the ball with a trajectory that is offset laterally to one side (e.g. right, FIG. 5A) or another (e.g. left, FIG. 5B). Specifically, the ball, e.g. as detailed in Example 1, can be loaded such that the plane connecting hemisphere 1 and hemisphere 2 is aligned with the center plane 16 of the drive wheel 13, as shown in FIGS. 5A and 5B. Such alignment can occur with hemisphere 1, having a plurality of arcuate grooves, to be aligned to the left (FIG. 5A) or right (FIG. 5B). An alternative manner to describe this orientation is the axis of rotation of the ball is the axis which connects the hemispheres 1,2 and the axis of rotation of the ball is aligned with the axis of ration of the drive wheel.

A typical ball (e.g. comparator ball constructed from the same materials as the present ball but not surface-modified), when projected from the drive wheel 13 of a pitching machine, will assume a trajectory that is straight, e.g. will travel across the apex 22 of home plate 17 next to which a batter stands. However, upon projection from the drive wheel 13 of the pitching machine, a ball of the invention, when oriented as described above, will assume a trajectory offset laterally. As depicted in FIGS. 5A and 5B, the offset trajectory can occur in the form of a curved trajectory 18,20 or in the form of an angled projection trajectory 19,21, as taught herein. Further, while FIGS. 5A and 5B depict the ball assuming a trajectory that curves away from the grooved side, the invention also contemplates structural features that cause curvature towards the side having the horizontal trajectory-controlling structure, as taught herein.

Example 3 Method of Projecting a Ball of the Invention with Controlled Vertical Trajectory A ball of the invention comprising a height-controlling structure can be projected from a pitching machine, whereby the user can control vertical trajectory, e.g. depending upon how the structure is oriented when the ball is loaded in a pitching machine. A hemisphere of the ball can comprise a height-controlling structure that increases or decreases traction, thus providing a ball having two hemispheres which exhibit different traction on the drive wheel of a pitching machine.

FIGS. 3A and 3B depict an example setup to practice a method of the invention. A pitching machine 12 is provided, distanced from a target, e.g. near batter 15. The pitching machine comprises a drive wheel 13, a chute 29 for loading a pitching machine ball, and a pinch plate 11 that is spaced from the wheel 13 such that the ball is slightly pinched or forced against the wheel 13 to cause the wheel 13 to project the ball. As detailed in FIG. 3A and FIG. 3B, depending upon how the ball is oriented, the pitching machine will project the ball with a trajectory that is relatively high (FIG. 3A) or relatively low (FIG. 3B). Specifically, the ball, e.g. as detailed in Example 1, can be loaded such that the interaction of the drive wheel and the ball ('drive wheel-ball projecting interaction') is dominated by the hemisphere 1 having a more tractive surface, whereby the ball is projected with a rate of spin greater than when the sports ball is oriented on the drive wheel such that the drive wheel-ball projecting interaction is dominated by the hemisphere 2 having the less tractive surface. Additionally or alternatively, the difference in spin rates between the high mode (FIG. 3A) and low mode (FIG. 3B) can influenced by the difference in interaction and traction of the hemispheres 1,2 with the pinch plate 11. In the depicted pitching machine 12, when one hemisphere (e.g. a more tractive hemisphere) is interfacing the drive wheel 13, the opposite hemisphere (e.g. a less tractive hemisphere) is interfacing the pinch plate 11. Thus, increased traction of hemisphere 1 on the pinched plate 11 can optionally cause more slippage between the drive wheel 13 and hemisphere 2, thus causing a relative decrease in spin rate and Magnus effect of the ball. Conversely, decreased traction of a second hemisphere on the pinched plate 11 can optionally allow less slippage and increased traction between the drive wheel 13 and the other hemisphere, thus causing a relative increase in spin rate and Magnus effect of the ball. Accordingly, the difference in spin rate of the ball when it is loaded traction side (e.g. hemisphere 1) up or down can be caused by a difference in on-wheel traction and/or on-pinch plate traction relative to the side exhibiting less traction (e.g. hemisphere 2).

As shown in FIGS. 3A and 3B, a drive wheel can optionally spin in a direction that produces back spin on the ball. Under this scenario, the ball when projected with a greater backspin, will undergo a greater Magnus effect and have a higher trajectory (FIG. 3A) relative to the ball when projected with less spin (FIG. 3B). The dominating interaction can be, for example, the last portion of the ball to contact the wheel. For example, depending on the location at which the ball first makes contact with the drive wheel, the ball may rotate one or more times while in contact with the drive wheel before disengaging from the drive wheel to begin its in-flight trajectory. Thus, a user, with only a few test pitches, can quickly compare loading positions and determine how to orient the ball to provide the hemisphere with more tractive surface as the dominating wheel-ball interaction to provide a relatively high trajectory (FIG. 3A) and determine how to orient the ball to provide the hemisphere with less tractive surface as the dominating wheel-ball interaction to provide a relatively low trajectory (FIG. 3B).

Example 4 Method of Throwing Ball with Controlled Vertical Trajectory and Controlled Lateral Trajectory A ball of the invention comprising a height-controlling structure and a horizontal trajectory controlling structure can be can be projected from a pitching machine, wherein the user can control the vertical trajectory and the horizontal trajectory. Further, while the instant application teaches various structural features for controlling horizontal trajectory and various structural features for controlling vertical trajectory, a ball of the invention may optionally comprise a hemisphere having a structural feature that controls both vertical and horizontal trajectory.

For example, the ball can have a hemisphere comprising a plurality of arcuate grooves, e.g. as detailed in Example 1, that are configured to control the horizontal trajectory and the vertical trajectory, e.g. depending upon how the hemisphere having the grooves is oriented when the ball is loaded in a pitching machine. Control of horizontal trajectory can occur as detailed in Example 2. Control of vertical trajectory can occur as detailed in Example 3.

Example 5 Manufacture of a Ball of the Invention

Figure 6A:
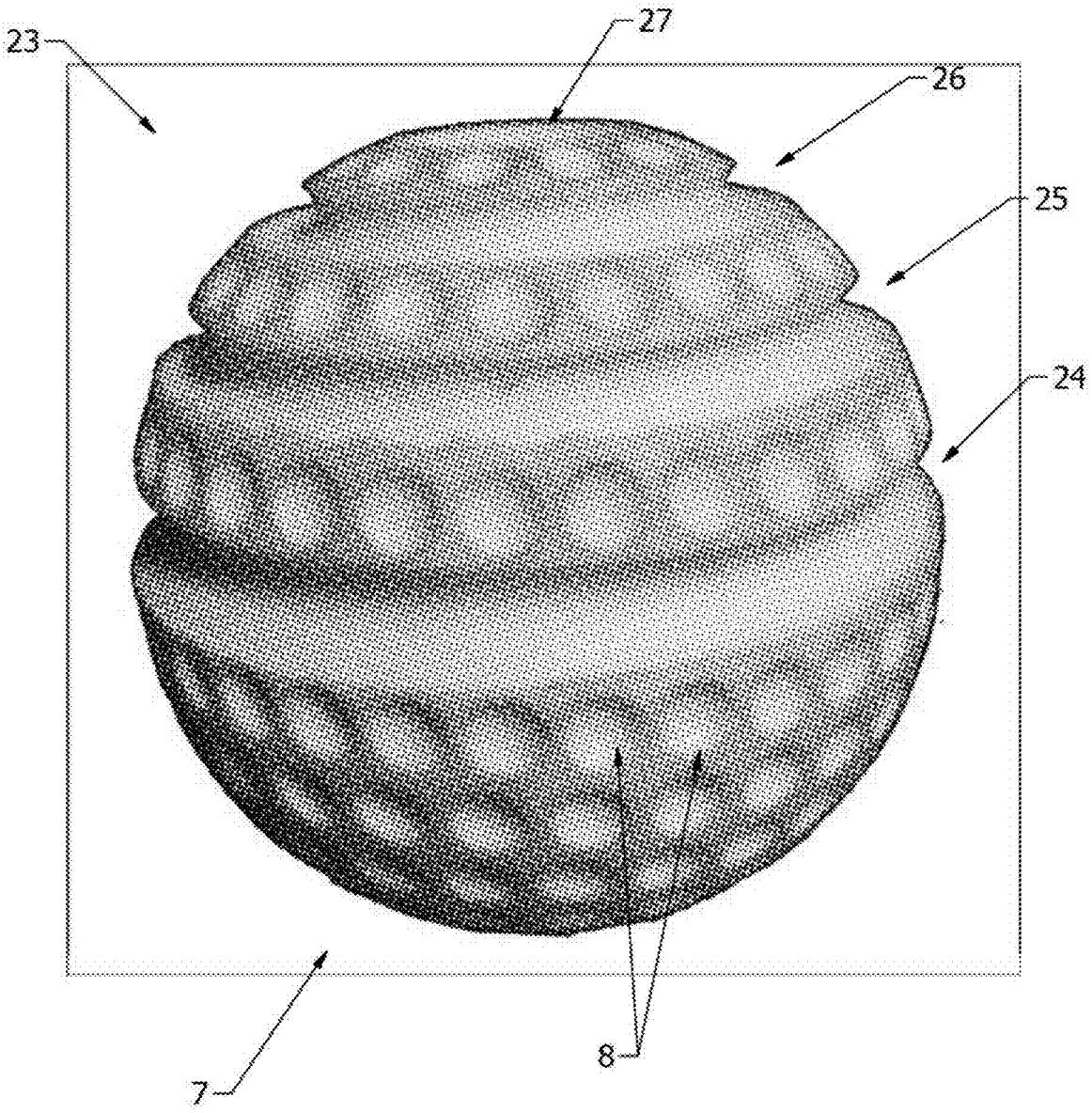
FIGS. 6A and 6B depict views of a ball of the invention.
Figure 6B:
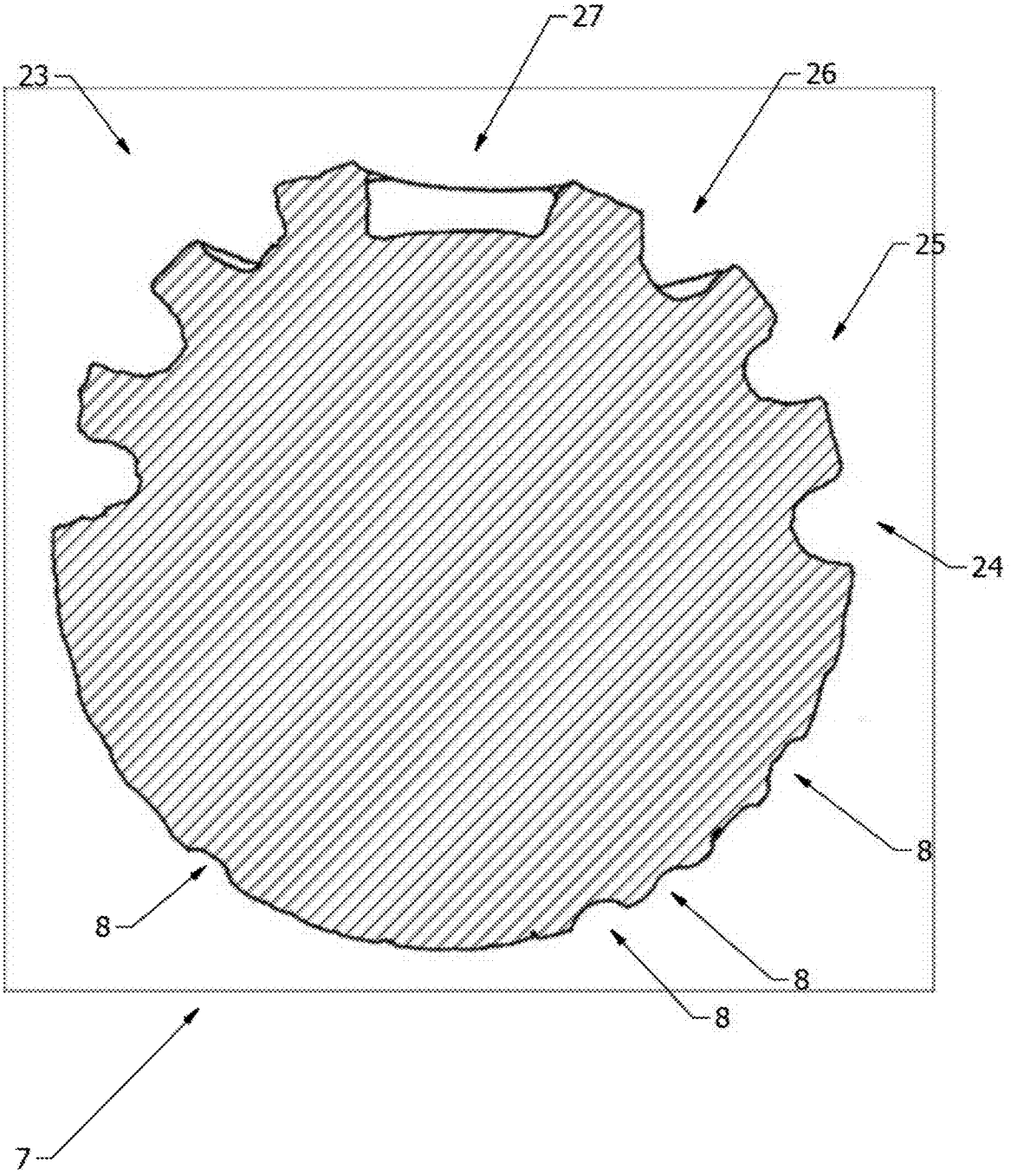

FIG. 6A depicts a photo of the ball of the invention made and tested by the inventor. FIG. 6B depicts a cross-section thereof showing the shape and depth of the grooves. The cross-section of FIG. 6B was digitally traced from a photo the ball after having been cut in half. The jagged edges shown in FIG. 6B were due to small pieces of foam that crumbled of the ball as it was being cut in half, and are not part of the ball detailed in this example.

To manufacture the ball, a molded polyurethane pitching machine ball (an example of a comparator ball relative to the ball of the invention detailed in the following example) was obtained weighing about 6.5 ounces and having a circumference of 12 inches and a hardness of 86 on the A-2 Shore durometer scale. The ball includes dimples across its entire surface. Using a ⅜ inch twist drill bit, a plurality of arcuate grooves 24, 25, 26 were cut around the ball. Using a ⅞ inch spade drill bit, a segment 27 was removed from the pole of the ball.

The depth of groove 24, the inner most groove adjacent to the equator, was about ⅜ in. The depth of groove 25, the middle groove, was about 5/16 in. The depth of the groove 26, the groove further from the equator, was about ¼ in. The spacing between grooves 24, 25, and 26 was about ⅜ in. The removed segment 27 had a depth of 7/32 in and a width of ⅞ in.

As shown in the drawings, the grooves have projection angles generally directed to the center of the ball (i.e. dRA, C is less than about 10 or 15 degrees).

The ball weighed 5.8 ounces after the removal of material for creating the grooves and removed segment.

Example 6 Ball of the Invention

The ball of the invention was provided using the manufacturing process detailed in Example 5. The ball comprises a first hemisphere 23 and a second hemisphere 7.

The first hemisphere 23 comprises arcuate grooves 24, 25, and 26 positioned about respective planes that are parallel to each other and parallel to a plane comprising the equator that joins the first hemisphere 23 and second hemisphere 7. The first hemisphere 23 further comprises a removed segment 27 which comprised a flat recessed surface. The spacing of the grooves and the dimensions of the grooves and removed segment is as detailed in the previous example.

Each of the arcuate grooves 24, 25, and 26 completely surround or arc around the ball, as shown in FIG. 6A, and penetrate the ball in a "U" shape, as shown in FIG. 6B.

Hemisphere 7 comprises a plurality of dimples 8.

The ball has a circumference of 12 inches and weighs 5.8 ounces.

Example 7 Testing of a Prior Art Ball

A commercially available ball made to the specifications as disclosed by U.S. Pat. No. 6,354,970 B1 to Reinke et al. was obtained. Specifically, the ball was a Rawlings® Curveball Trainer ball. As described by Reinke, this ball has a hemisphere comprising grooves that impart curvature towards the hemisphere with the grooves when the ball is thrown and it spins on an axis extending through the hemisphere. As further described by Reinke, this ball is made extremely light to allow relative air pressure difference imparted by the grooves to provide a substantial curve to the ball. When the inventor attempted to load this ball into the pitching machine, it did not produce a satisfactory trajectory, namely the ball skipped on the drive wheel and bounced off, hitting the ground only a few feet away. In other words, the trajectory did not resemble that required for use of a ball with a pitching machine.

Example 8 Testing of a Prototype Ball

Prior to manufacturing the ball detailed in Example 5, the inventor manufactured a ball identical to that of Example 5, but having its grooves drilled to a shallower depth to mimic that of the Rawlings® Curveball Trainer ball. This experiment was conducted to determine if it were possible to induce a curve with a heavier ball that would be pitched from the pitching machine with a sufficient velocity. However, the ball, even when oriented in the manner known to produce a curveball (having grooves to the left or right), did not produce any curve at all. While it was expected that the curving effect would be less pronounced due to the heavier weight of the pitching machine ball, it was surprising, however, that the appeared to project with a perfectly straight trajectory. In other words, no curving effect was seen at all.

However, upon several attempts at differentially orienting the ball during loading of the ball into the pitching machine, it was surprisingly discovered that the user could control vertical trajectory by placing the grooved hemisphere side up or side down when loading the ball into the pitching machine. This effect is the same as detailed in FIGS. 3A and 3B and detailed in Example 3. This was quite surprising, for example, because it has never been suggested to alter the traction of a portion of a pitching machine ball to create a ball having multiple modes of pitching differentiated by their vertical trajectory. Further surprising is that surface shape such as grooves could be used to provide this altered traction.

Further surprising is that, depending of the depth of the grooves, the ball was able to be pitched with different lateral trajectories. The ball was modified from a ball having a substantially no lateral trajectory to a ball having a controllable lateral trajectory by deepening the grooves.

Example 9 Testing of a Ball of the Invention

The ball detailed in Example 6 was tested for is in-flight properties when projected from a pitching machine. The pitching machine included a drive wheel 13 as shown in FIG. 4. Specifically, the Jugs M1200 pitching machine was used, oriented horizontally, at a speed setting of 60 miles per hour (mph). The pitching machine was positioned 40 feet from home plate.

As with previous experiments, the ball of the invention surprisingly had a controllable vertical trajectory based on whether the grooved hemisphere was oriented side up or side down on the drive wheel of the pitching machine (e.g. in the manner detailed in FIGS. 3A and 3B). When oriented groove side down (high mode shown in FIG. 3A), the ball crossed home plate at a relatively high height. When oriented groove side up (low mode shown in FIG. 3B), the ball crossed home plate at a relatively low height. Further surprising is that, when a comparator pitching machine ball of identical composition, but not modified according to the present invention (i.e. the original retail pitching machine ball from which the invention was made by forming grooves) was projected from the pitching machine (i.e. a normal fastball), the ball crossed home plate at a height intermediate of the high ball mode and low ball mode of the ball of the invention. Accordingly, the low ball mode of projecting the ball of the invention was actually found to experience more drop than a normal fast ball. This is quite surprising because the ball-wheel interface is the same for both an unmodified ball and the low mode test inventive ball (i.e. a non-grooved surface). It was expected that the low mode of the ball of the invention would be experience the same drop as a normal fastball of a control comparator ball (i.e. an identical ball with the same composition except unmodified for traction according to the present invention) due to them having the same on-wheel traction. Thus, it is surprising that a ball of the invention optionally exhibits a low mode in which it experiences a greater drop relative to a respective comparator ball. Without being bound by theory, the inventor believes this phenomenon was due to unequal weights of hemispheres 1 and 2, which caused a small amount (unperceivable to the naked eye) of in-flight wobble during back spin. Presumably, this wobble either decreased the Magnus effect at the same back spin rate, or caused a slowing of the back-spin during its flight, also reducing the Magnus effect. Additionally or alternatively, the effect could have been caused by a reduced gyroscopic effect induced by wobble.

Further surprising is that the ball also had controllable lateral trajectory when the grooved hemisphere was oriented to the left or right in the manner detailed in FIGS. 5A and 5B. Specifically, the ball had a trajectory left of center (left of apex 22, FIG. 5B) when the ball was loaded with the grooves to the right side of the drive wheel and the ball had a trajectory right of center (left of apex 22, FIG. 5A) when the ball was loaded with the grooves to the left side of the drive wheel. This altered lateral trajectory appeared to be the result or both of a curving and angled trajectory.

The ball exhibited lateral deviation of several inches left or right from center (apex 22) after 40 feet in-flight projected at 60 mph.

Example 10 Modification of Ball Characteristics

Several balls were produced that were similar to the ball detailed in Example 6, except the groove dimensions were modified. It was found that lateral movement increased as groove depth increased and the difference in height between the ball projected in high mode and low mode increased as groove depth increased.

As in the previous example, the Jugs M1200 pitching machine was used, oriented horizontally, at a speed setting of 60 miles per hour (mph). The pitching machine was positioned 40 feet from home plate.

Surprisingly, by configuring the grooves appropriately, a ball was produced exhibiting each of: a desired lateral movement of 9 inches left or right of center (when the grooved side is oriented to the left or right), a desired change in vertical movement between high ball mode and low ball mode (when the grooved side is oriented up or down) of 36 inches, a desired height when projected in high ball mode of 52 inches, and a desired height when projected in low ball mode of 16 inches. Accordingly, the difference in height of the ball when pitched grooved sided up verses grooved side down was about 36 inches after 40 feet in-flight projected at 60 mph from the M1200 pitching machine. This is quite remarkable that the modification of a ball with grooves was able to produce a ball with desired lateral movement, desired absolute heights of the low and high modes and desired height change of the high and low modes. These characteristics of desired lateral movement, high pitch height and low pitch height fall within desired ranges for typical batters (e.g. within or close to the strike zone of a typical batter).

The ball that provided the desired characteristics described above had groove depths of 5 mm, groove widths of 1 cm, a removed segment with a width of 2.2 cm width and 5 mm depth, and a total ball weight of 5.9 oz, which was 0.6 oz less than the starting weight of the ball before material removable by groove formation.

Other balls were similarly created having even deeper grooves and it was found that the vertical and horizontal trajectory could be modulated to a great extent, if desired (e.g. a difference in height of 50 inches of low mode vs high mode) and a lateral movement of much greater than the strike zone, e.g. laterally offset 15 inches or more from center). Thus, it was found that grooves could be created so deep that lateral movement and vertical changes were greater than desired for this particular application (pitching from 40 feet at 60 mph). Accordingly, a skilled artisan, with the teachings provided herein, can readily modify the in-flight characteristics of a ball to produce the desired effect.

Further, it is noted that lateral movement and absolute height can be modified by changing the weight of the ball. Further, it is noted that lateral movement and height can be independently modified. For example, the design can be modified by adding a tractive surface or lubricating surface to increase or decrease the change in height between high mode and low mode. As another example, the design can be modified by increasing or decreasing the difference in weight between two hemispheres to decrease or increase the absolute height. As another example, the design can be modified by modifying groove depth or adding or subtracting grooves to change the lateral movement and optionally adding a tractive or lubricating surface and/or changing the relative weight of the hemispheres to modify absolute height as discussed supra.

Example 11 Groove Shape

Figure 7:
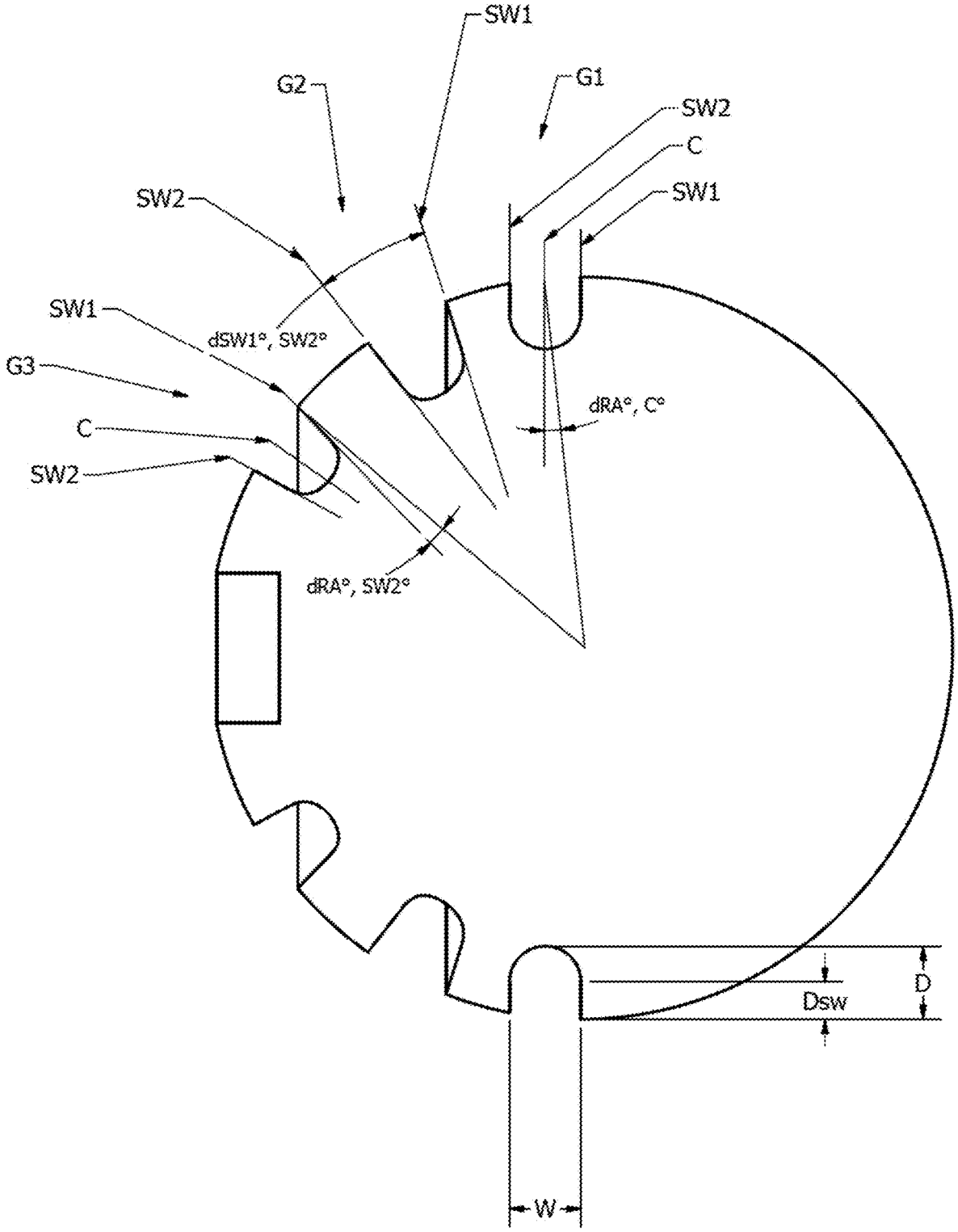
FIG. 7 depicts the cross-section of a ball of the invention and several optional measurements of grooves of a ball of the invention.

FIG. 7 depicts a cross-section of a ball that exhibited the controllable vertical and horizontal trajectory according to the present invention (i.e. the ball curves away from the first hemisphere comprising the grooves, when projected from the wheel of a pitching machine). Specifically, the ball is the same ball shown in FIG. 1F, however, the cross-sectional hatching is removed for better viewing of the feature labels. All curvature discussed in this example is curvature away from said first hemisphere when projected from the wheel of a pitching machine as taught herein.

Three grooves, G1, G2, and G3 are shown.

The Grooves have a protrusion angle C, i.e. the angle of an imaginary line extending from the center of the groove at the ball surface (mouth) of the groove to the center of the base of the groove.

The grooves each have two side walls, each with a sidewall angle (SW1, the angle of the sidewall proximal to the equator which separates the first and second hemispheres, and SW2, the angle of the sidewall which is distal from the equator). The sidewall angle can be measured along a portion of the sidewall Dsw that extends a specified depth (e.g. at least 25% or at least 50% of the depth of the groove).

"dRA, SW" is the difference in angle between a sidewall angle (SW1 or SW2) and the angle of the radius of the ball (measured at the sidewall). For example, "dRA, SW2 (the difference in angle between the radius and SW2) is shown for groove G3 in FIG. 7. The present inventor has discovered that it is preferable to make the dRA, SW very small for a substantial portion of the sidewall (e.g. at least 50% of the depth D or more such at 70% or more).

"dRA, C" is the difference in angle between the protrusion angle (C) of a groove and the angle of the radius of the ball (measured to the center of the groove surface). For example, "dRA, C is shown for groove G1 in FIG. 7.

"dSW1,SW2" is the difference in angle between each of the sidewalls of a respective groove. For example, "dSW1, SW2" is shown for groove G2 in FIG. 7. If a sidewall exists at multiple angles (e.g. has a curve to the sidewall), the dSW1,SW2 can be provided as the difference between the average angle of each sidewall, or can be provided as the difference in angles of respective portions of the sidewalls that have a dRA, SW within a specified rangle (e.g. <30 degrees). The present inventor has discovered that it is preferable to make the dSW1, SW2 very small for a substantial portion of the sidewall (e.g. a Dsw at least 50% of the depth D or more such at 70% or more).

The grooves have a width W and a depth D. In general, it has been discovered that deeper grooves provide more curvature.

The grooves have a depth Dsw, which is the depth of a specified portion of the respective sidewall. The specified portion of the sidewall can be a sidewall portion which extends at a specified angle, relative to the angle of the radius of the ball at the sidewall, i.e. a dRA, SW within a specified rangle (e.g. <30 degrees), or extends at a specified angle relative to the opposite sidewall i.e. a "dSW1,SW2" within a specified range. In general, it has been discovered that grooves with a deep Dsw portion of the sidewall having a small dRA, SW or small dSW1,SW2" provide greater curvature.

Each of the above features has been discovered by the inventor to play a role in determining whether a ball exhibits curvature away from the grooved hemisphere and/or the amount of curvature exhibited.

Figure 8:
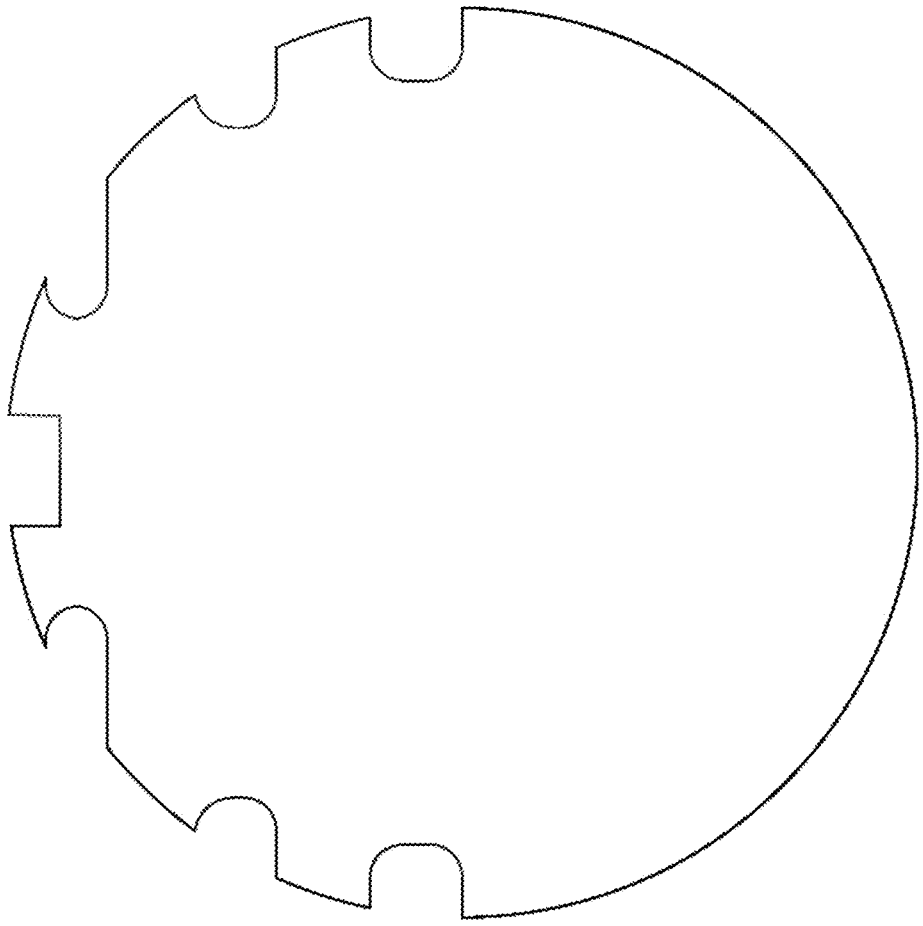
FIG. 8 depicts a test ball that did not curve away from the grooved hemisphere in a test.

For example, it has been discovered that a small dRA, C increases the curvature, and that a large dRA, C, such as that shown in FIG. 8 can eliminate the curvature. For example, FIG. 8 shows a ball made with grooves extending perpendicular to the axis of rotation. The ball was otherwise made with the groove dimensions D and W and dSW1,DSW2. However, the ball did not exhibit the desired curvature.

Figure 9:
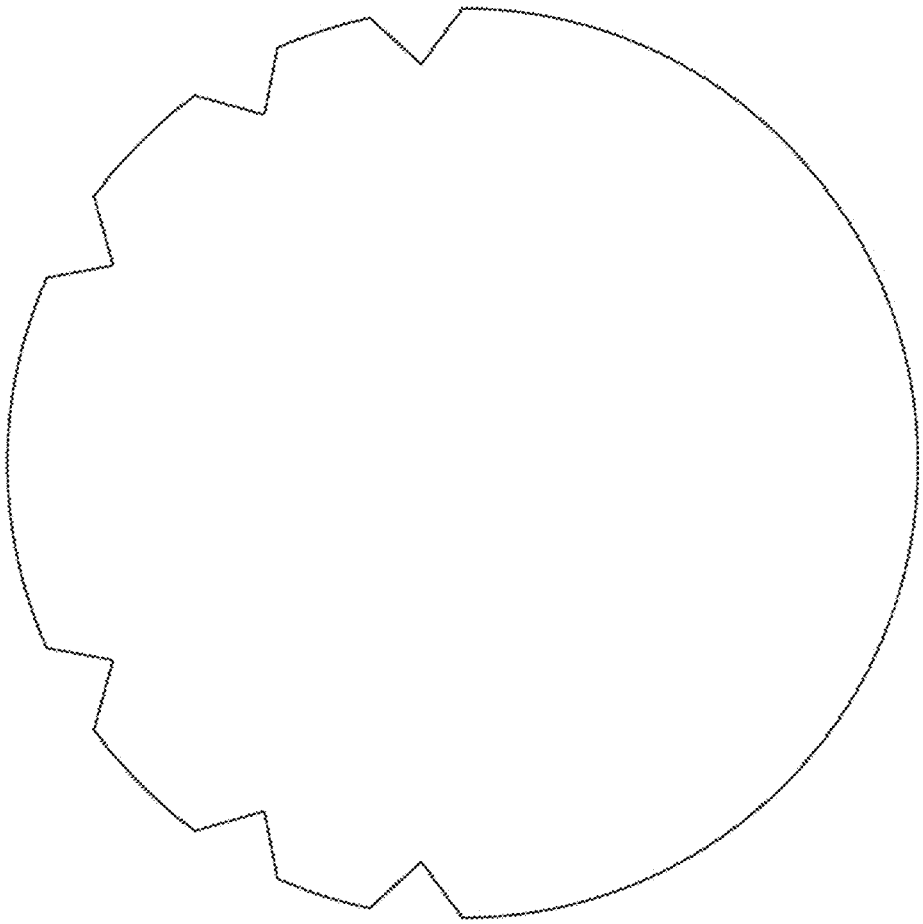
FIG. 9 depicts a test ball that did not curve away from the grooved hemisphere in a test.
Figure 11:
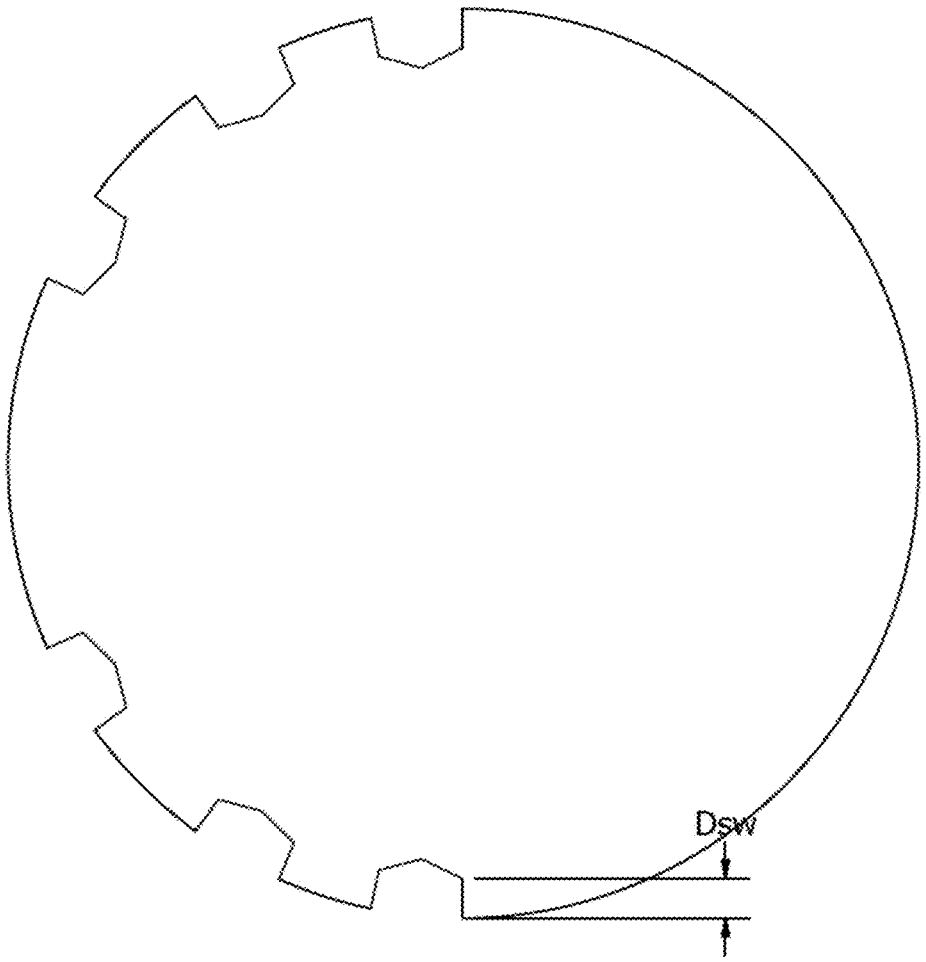
Figure 12:
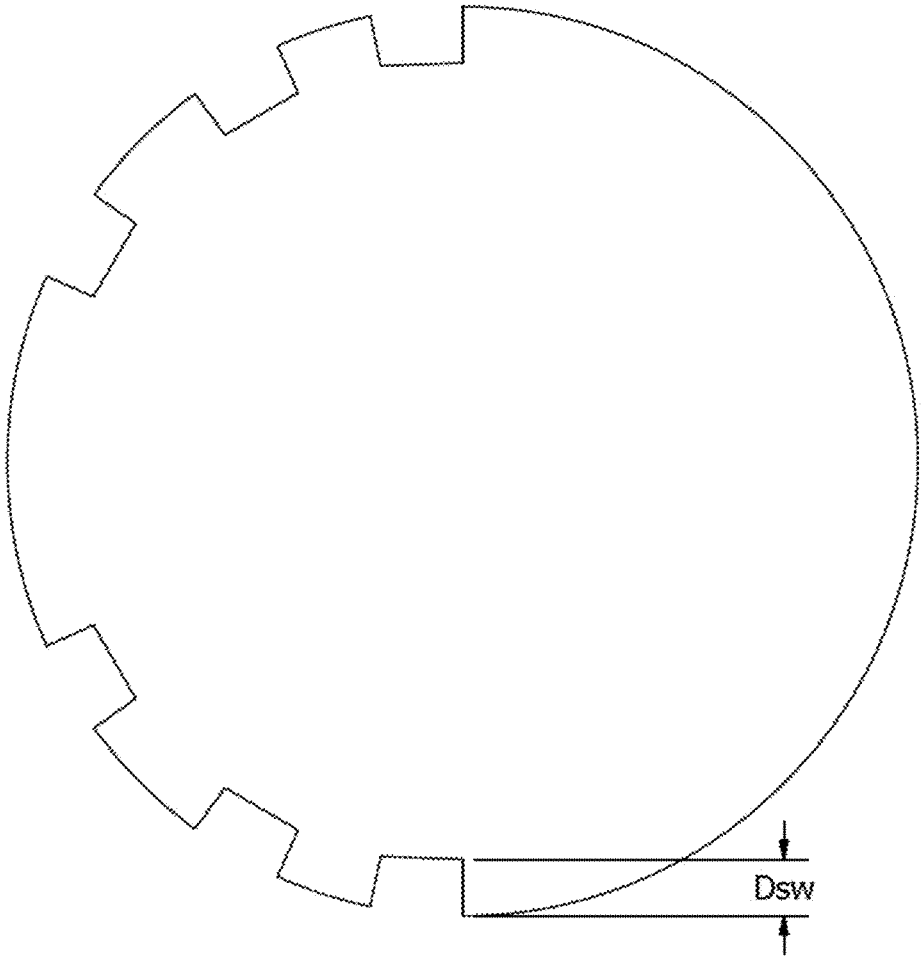

However, it has also been discovered that, at least in some scenarios, a small dRA, C is not alone sufficient to provide the curvature. For example, although not labeled, the three grooves of the ball in FIG. 9 have the same dRA, C as the grooves in FIG. 7. However, in tests performed with high density balls, the ball of FIG. 9 did not produce the curvature. Without being bound by theory, the present inventor believes the ball of FIG. 9 fails to provide the desired curvature because, although the dRA, C is deemed acceptable, the angle between the sidewalls dSW1,SW2 (or a substantial portion of the sidewalls, Dsw) is not small enough (note, dSW1,SW2 of the sidewalls in FIG. 9 is about 85 degrees). However, the balls shown in FIGS. 10-12 provided the desired curvature, and had the same total depth D as the ball of Fig. and 9. The inventor points out that the grooves of the balls in FIGS. 10-12 have parallel or almost parallel sidewalls (a small dSW1,SW2 over a substantial portion of sidewall depth Dsw) and have sidewalls portions with a substantial portion (Dsw) that is within a tolerable angle relative to the radius angle measured at the sidewall (i.e. a dRA, SW1 and dRA, SW2 that are small enough). Thus, it was concluded that, given an acceptable protrusion angle of the groove (dRA, C), grooves can provide the desired curvature if, for example, they are made to an appropriate depth D (or depth Dsw) and the dSW1,SW2 is made small enough (e.g. for a substantial depth of sidewall Dsw) and/or the dRA,SW (e.g. for a substantial depth of sidewall Dsw) of each of the sidewalls within a tolerable amount (e.g. close to zero). For example, the inventor has performed tests which demonstrated that dSW1,SW2 of 30 degrees or less for a substantial portion of the groove sidewall Dsw (about 50% of the groove depth) provided the desired curvature, although larger values of dSW1,SW2 might still be acceptable, provided that the dRA,C was within a tolerable amount (e.g. zero).

Accordingly, the inventor contemplates balls having grooves in which one or both of the sidewalls have a substantial depth of sidewall portion Dsw, wherein all of the sidewall within said portion Dsw has as an angle relative to the radius (dRA,SW) less than a first amount (e.g. less than 30 degrees or less than 20 degrees) and/or has as an angle relative to the Dsw of the opposing sidewall less than a second amount (e.g. less than 40 degrees or less than 30 degrees).

Optionally, the total depth of the groove D is at least 4% of the diameter of the ball, or at least 5% of the diameter of the ball (e.g. and less than 11% of the diameter of the ball), e.g as in Example 14.

Optionally, the at least 25% (e.g. at least 50%) of the groove depth D is a portion Dsw having the features described above).

Example 12 Groove Interruptions and Groove Length Ratio

While the present invention can optionally use uninterrupted grooves, the present inventor has discovered that it is possible to provide interruptions in the grooves and still provide for curvature away from the first hemisphere comprising the grooves.

Figure 13:
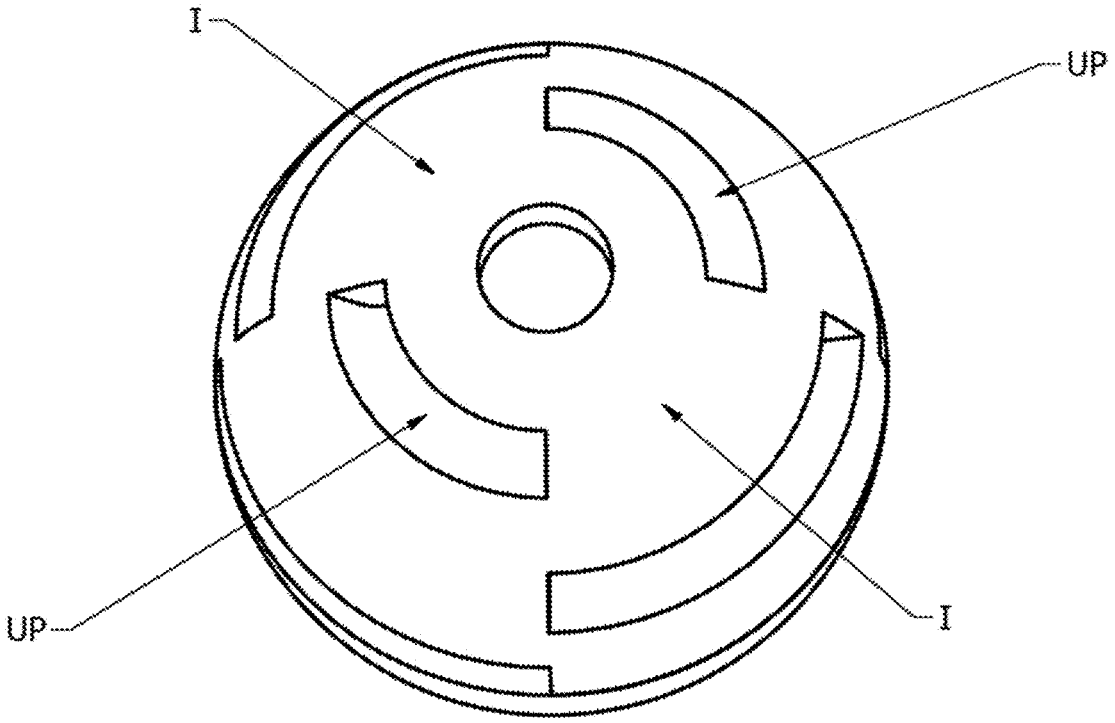
FIG. 13 depicts a ball with grooves with interruptions.

FIG. 13 depicts a test ball that was produced by interrupting grooves with interruptions I, thereby providing a groove with uninterrupted portions UP separated by interruptions. Other than the interruptions, the grooves had a shape and depth that was previously demonstrated to provide the desired curvature (8 mm depth, 1 cm wide on a ball with an 12 inch diameter, with the groove shape shown in FIG. 7). In the ball shown in FIG. 13, the sum of both uninterrupted portions of groove is 50% of the cross-sectional circumference of the ball surface (measured at the groove location, not the equator), and the sum of the interruptions is also 50%. This ball demonstrated a very slight curvature (3 inches lateral movement over longitudinal distance of 40 feet when being projected from a pitching machine at 60 mph). Increasing the total sum length of uninterrupted portions increased the curving amount (75% sum uninterrupted portions provided about 6 inches lateral curvature over 40 longitudinal feet pitched at 60 mph), while decreasing the total sum length of uninterrupted portions increased the curving amount (25% sum uninterrupted portions provided about no noticeable lateral curvature over 40 longitudinal feet pitched at 60 mph).

However, it was demonstrated that, if the uninterrupted portions were severely shortened (e.g. increasing the number of interruptions such that the width to length ratio of each uninterrupted portion was 1:1 while keeping the sum of the uninterrupted portions at 50% of the circumference, thus providing short uninterrupted portions), the ball did not demonstrate the desired curving affect. Accordingly, the invention contemplates embodiments wherein the ratio of arc length (i.e. length of circumference) of groove to depth is at least 2:1 or at least 3:1 or at least 4:1 or at least 5:1 or at least 6:1 or at least 7:1 or at least 8:1 or at least 9:1 or at least 10:1. Additionally or alternatively, the invention contemplates embodiments wherein the ratio of arc length of groove to groove width is at least 2:1 or at least 3:1 or at least 4:1 or at least 5:1 or at least 6:1 or at least 7:1 or at least 8:1 or at least 9:1 or at least 10:1.

Example 13 Test Balls

A plurality balls were produced and tested for their ability to curve when projected at 60 mph over a distance of 40 feet from a single-wheeled pitching machine (Jugs® M1200). The test results are shown in the table below.

Ball No. 1 had the three grooves, with the a concave segment removed from the end. Specifically, the ball had the three annular grooves and the concave segment (concave end) shown in FIG. 7, and dimples on the opposing hemisphere and between the grooves as shown in FIG. 6A. The ball had a 12 inch circumference and weighed 6.5 oz (184 grams), before the grooves and end segment were removed, giving it a high density of 0.385 grams/cubic centimeter (the density of this polyurethane ball does not change upon removal of material). The grooves were made to a depth D of 8 mm, a width W of 1 cm, a groove protrusion angle such that dRA, C was zero for grooves 2 and 3 (G2 and G3) and about 6 degrees for groove 1 (G1). Each of the grooves had sidewall portions that were straight with a depth Dsw of 5 mm. The sidewall portion of respective sidewalls were parallel to each other (i.e. dSW1,SW2 of zero for the Dsw of each sidewall of a given groove). The concave segment removed from the end had a depth of 8 mm and a diameter of 1 inch. This ball is a preferred embodiment of the invention. As shown in the table, the ball curved 8.5 inches away from the grooved hemisphere when projected at 60 mph over a distance of 40 feet. This is a preferred embodiment of the invention, because home plate has a width of 17 inches, and 8.5 inches is the furthest the ball can curve while still representing a strike to the batter.

Ball number 2 was made the same as ball number 1 except that the end segment was not removed. This ball also curved according to the invention, albeit less than ball 1. Additionally, the inventor noted that there was slight variability in the amount the ball curved.

Ball 3 was the same as ball 1 except that it did not include groove G3.

Ball 4 was the same as ball 3, except that the end segment was not removed. This ball curved slightly less than 3 inches.

Balls 5-8 were made with a single groove 8 deep, but with varying width, and with or without the concave end segment. These balls curved less than 3 inches or wobbled too much for accurate measurement.

Balls 9 and 10 were made with only a single groove. The balls did not demonstrate measurable curve.

Balls 11-19 were made to test the ability of a ball made with grooves having interruptions. Other than the interruptions, the ball had the same groove dimensions and shape as ball 1. Balls 11-16 all had a single uninterrupted groove portion (per annular groove) and a single interruption. These balls differed by how long the uninterrupted groove portion was and whether ball included a concave end. Balls 17-19 had two interruptions on opposing portions of the circumference of the ball, with the total sum of the uninterrupted groove adding to 25% (90 degrees), 50% (180 degrees) or 75% (270 degrees) of the respective annular circumference (i.e. the circumference measured at the groove (not the equator)). As an example, Ball 18 is shown in FIG. 13. Balls 17 and 19 were the same as Ball 18, except with longer or shorter lengths of uninterrupted groove. Ball 13 had an acceptable amount of curvature, although it did not curve as much as ball 1.

Ball 20 had grooves G1 and G2 the same as ball 1, and had an end segment completely removed (e.g. as in FIGS. 1 and 5 of U.S. Pat. No. 4,128,238). This ball curved a large amount. However, this ball has poor results when attempting to produce a riseball/drop ball, as the cutoff segment interferes with the balls ability to property roll on the pitching machine wheel, depending on the size of the cuttoff. Further, although this ball curves a large amount, it is easy for a batter to notice the cutoff segment and can predict which way the ball will curve before it is projected from the pitching machine. This is a disadvantage for coaches trying to surprise their batters with a curveball.

Additionally, the inventor noted that balls 1-3 and 14 produced acceptable control of vertical trajectory (rise ball and/or drop ball) when projected as in FIGS. 3A,3B.

TABLE 1 test Balls

| Ball No. | Ball Type | Curve |
|---|---|---|
| 1 | 3 Grooves w/concave end | 8.5" |
| 2 | 3 Grooves | 6.5-7.5" (had variability) |
| 3 | 2 Grooves (groove 1 and 2) w/concave end | 6" |
| 4 | 2 Grooves (groove 1 and 2) | <3" |
| 5 | 1 Large groove (2 cm wide) w/concave end | <3" |
| 6 | 1 Large groove (2 cm wide) | <3" |
| 7 | 1 Large groove (3 cm wide) w/concave end | WOBBLED too much for measurement |
| 8 | 1 Large groove (3 cm wide) | WOBBLED too much for measurement |
| 9 | 1 groove w/concave end | NO |
| 10 | 1 groove | NO |
| 11 | 3 Grooves 25% circumference uninterrupted groove (one uninterrupted groove) with 75% interruption (one interruption) w/concave end | NO |
| 12 | 3 Grooves 50% circumference uninterrupted groove (one uninterrupted groove) with 50% interruption (one interruption) w/concave end | <3" |
| 13 | 3 Grooves 75% circumference uninterrupted groove (one uninterrupted groove) with 25% interruptions (one interruption) w/concave end | 6" |
| 14 | 3 Grooves 25% circumference uninterrupted groove (one uninterrupted groove) with 75% interruption (one interruption) | NO |
| 15 | 3 Grooves 50% circumference uninterrupted groove (one uninterrupted groove) with 50% interruption (one interruption) | <3" |
| 16 | 3 Grooves 75% circumference uninterrupted groove (one uninterrupted groove) with 25% interruptions (one interruption) | <3" |
| 17 | 3 Grooves 25% circumference uninterrupted groove (two uninterrupted grooves cumulative sum of 25% circumference) with 75% interruption (two interruptions cumulative sum of 75%) w/concave end | NO |
| 18 | 3 Grooves 50% circumference uninterrupted groove (two uninterrupted grooves cumulative sum of 50% circumference) with 50% interruption (two interruptions cumulative sum of 50%) w/concave end | <3" |
| 19 | 3 Grooves 75% circumference uninterrupted groove (two uninterrupted grooves cumulative sum of 75% circumference) with 25% interruptions (two interruptions cumulative sum of 25%) w/concave end | <3" |
| 20 | 2 Grooves end sliced off (8 mm depth cut off end) | 15 inches |

Example 14 Groove Depths

Several balls of the invention were created with the characters of ball 1 of the above example, except that the size of the ball was varied (9 inch circumference bass ball or 12 inch circumference softball), and the groove depths and widths were varied.

For a 12 inch ball with high density, it was discovered that groove depths of 5-10 mm were generally effective to produce acceptable curve (by loading via FIGS. 5A, 5B) and control of vertical trajectory (by loading via FIGS. 3A,3B), given that one or more other features of the ball were acceptable (e.g. as in FIG. 7).

For a 9 inch ball with high density, it was discovered that groove depths of 3-7 mm were generally effective to produce acceptable curve (by loading via FIGS. 5A, 5B) and control of vertical trajectory (by loading via FIGS. 3A,3B).

Generally, deeper grooves produced greater curvature and greater change in vertical trajectory while shallower grooves had the opposite effect. Increasing density requires greater groove depths to product the same effect, all else being equal.

Optionally, the total depth of the grooves D is at least 3% of the diameter of the ball, or is at least 4% of the diameter of the ball, or at least 5% of the diameter of the ball (e.g. and less than 11% of the diameter of the ball). Optionally, the sidewalls of said grooves, over at least 25% or at least 50% of the depth of the groove, is less than 20 degrees different than the radius (dRA,SW) and/or less than 20 degrees different than the opposing sidewall (dSW1,dSW2).

Balls that curve too much or too little can be undesirable for certain applications. For example, if it curves too little, it does not challenge the batter enough. If it curves too much, it does not represent a strike, or even worse, it can curve into the batters box (potentially injuring the batter). Similarly, balls that have too much or too little change in vertical trajectory can be undesirable as they either don't challenge the batter enough or don't represent real-world scenarios. What was extremely surprising is that it was possible to create, with a single grooved ball structure, a ball that produces a desirable amount controlled vertical trajectory and desirable amount of controlled horizontal trajectory, as these two applications happen based on different phenomena (comparing FIG. 3 to FIG. 5).

Thus, with the teachings provided herein, one skilled in the art can readily provide a ball that targets acceptable ranges of both controlled vertical and horizontal trajectory.

Accordingly, one embodiment of the invention provides a ball having grooves, as taught herein, in which the difference in height (after 40 feet from pitching machine to home plate) when comparing the high ball mode (e.g. as in FIG. 3A) and the low ball mode (e.g. as in FIG. 3B) is between 10 inches and 50 inches (e.g. between 15 and 40 inches or between 20 and 40 inches) when initially projected at a horizontal angle at 60 mph. Additionally or alternatively, the ball demonstrates a curve (away from the grooved hemisphere as in FIG. 5) of 3-15 inches (i.e. the ball arrives at home plate to the left or right of center by 3-15 such that the difference between the left-curving ball and the right-curving ball is 6-30 inches), e.g. 3-10 inches or 5-10 inches.

Figure 14A:
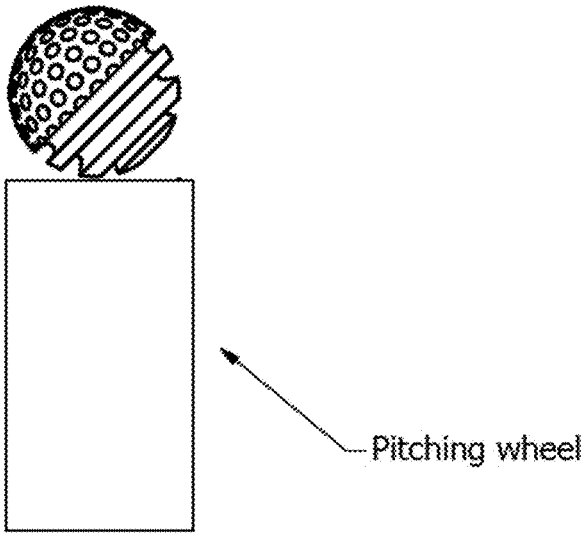
FIG. 14A depicts a manner in which a ball of the invention can be loaded to simultaneously modulate vertical and horizontal trajectory.
Figure 14B:
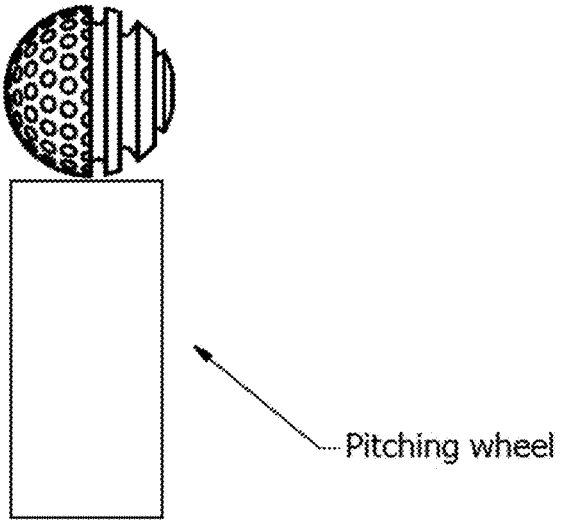
FIG. 14B depicts a manner in which a ball of the invention can be loaded to modulate horizontal trajectory.
Figure 14C:
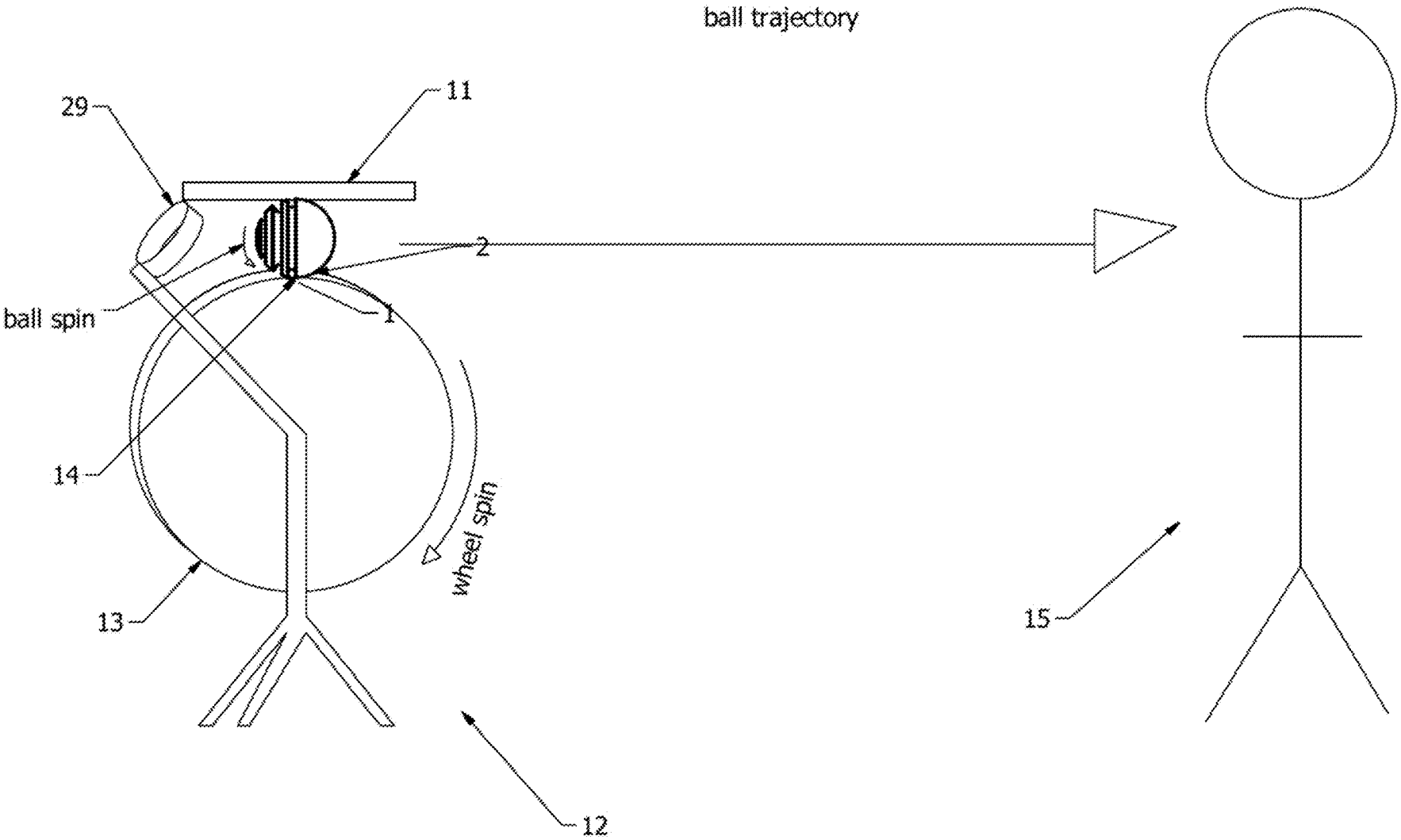
FIG. 14C depicts a manner in which a ball of the invention can be loaded to pitch a fast ball (no modulated vertical or horizontal directory)

Surprisingly, this ball can optionally also be pitched from the pitching machine as a fast ball (not exhibiting curve or rise/drop) by placing it on the wheel of a pitching machine as shown in FIG. 14C (i.e. placed on the wheel at the equator separating the first and second hemispheres). Also surprising is that the ball can be pitched with a moderate curve (i.e. slightly less curve relative to the mode in FIG. 5) and a moderate change in vertical trajectory (i.e. slightly less relative to the mode in FIG. 3) by placing on the pitching machine as shown in FIG. 14A (i.e. angled to the side at about 45 degrees to pitch a high left ball). Note: FIGS. 14A-14B are all shown from the rear view, with the pitch projecting into the background, and FIG. 14B is the same loading position as in FIG. 5B (which pitches a curveball to the left). Similar to the high left ball of FIG. 14A, a low left, high left, and high right ball can be pitched by placing the ball at different orientations. Accordingly, a single ball can, depending on how it's loaded throw 7 different pitches: a fast ball, a high ball, a low ball, a high right ball, a high left ball, a low right ball and a low left ball.

The citations provided herein are hereby incorporated by reference for the cited subject matter.

The invention also contemplates an ornamental design for any of the balls shown in the figures.

What is claimed is:

1. A sports ball comprising a first hemisphere and a second hemisphere, wherein:

a. the first hemisphere and the second hemisphere are non-overlapping;

b. the first hemisphere comprises a plurality of grooves;

c. the plurality of grooves are arcuate grooves running substantially parallel to an equator that separates the first hemisphere from the second hemisphere;

d. the plurality of grooves are configured such that when the ball is projected from a drive wheel of a pitching machine after being oriented such that the first hemisphere is set laterally to a first side of a center plane of a drive wheel of the pitching machine such that an axis of rotation of the ball extends from the first hemisphere to the second hemisphere, the trajectory of the projected ball is offset laterally toward a second side of the center plane opposite the first side;

e. the ball has a density of at least about 0.2 g/cm$^3$; and f. the plurality of groove are configured such that:

i. each of the plurality of grooves is a continuous groove or a non-continuous groove, wherein, when the groove is the non-continuous groove, the non-continuous groove comprises one or more uninterrupted portions of groove and one or more interruptions, wherein the one or more uninterrupted portions of groove have a ratio of length to width of at least 2:1, and wherein the one or more uninterrupted portions of groove have a cumulative arc angle of greater than 180 degrees;

ii. each of the plurality of grooves has a depth of at least 3% of a diameter of the ball;

iii. each of the plurality of grooves has two opposing sidewalls having protrusion angles less than 30 degrees relative to each other; and iv. the plurality of groove are configured with one or more of the features selected from the group consisting of:

1. each of the plurality of grooves has a protrusion angle of less than 15 degrees relative to a radius of the ball that extends to a center of the groove at a surface of the ball; and 2. each of the plurality of grooves has a sidewall having a protrusion angle of less than 30 degrees relative to a radius of the ball that extends to the sidewall at a surface of the ball.

2. The sports ball of claim 1, wherein the second hemisphere does not comprise grooves or wherein arcuate grooves are provided to a greater extent on the first hemisphere than the second hemisphere.

3. The sports ball of claim 1, wherein the plurality of grooves are configured such that when the ball is projected from the drive wheel of the pitching machine such that the axis of rotation of the ball is between the first hemisphere and the second hemisphere, the trajectory of the ball is higher when the ball was loaded on the drive wheel such that the wheel-ball interaction is dominated by the first hemisphere compared to when the ball was loaded on the drive wheel such that the wheel-ball interaction is dominated by the second hemisphere.

4. The sports ball of claim 1, wherein the second hemisphere comprises a plurality of dimples.

5. The sports ball of claim 1, wherein the plurality of grooves consists of 2 grooves or 3 grooves.

6. The sports ball of claim 1, wherein the plurality of grooves are arcuate grooves concentric about an axis of the ball that is perpendicular to the equator.

7. A sports ball comprising a first hemisphere and a second hemisphere, wherein:

g. the first hemisphere and the second hemisphere are non-overlapping;

h. the first hemisphere comprises a plurality of grooves;

i. the plurality of grooves are arcuate grooves running substantially parallel to an equator that separates the first hemisphere from the second hemisphere;

j. the plurality of grooves are configured such that when the ball is projected from a drive wheel of a pitching machine after being oriented such that the first hemisphere is set laterally to a first side of a center plane of a drive wheel of the pitching machine such that an axis of rotation of the ball extends from the first hemisphere to the second hemisphere, the trajectory of the projected ball is offset laterally toward a second side of the center plane opposite the first side;

k. the ball has a density of at least about 0.2 g/cm$^3$;

l. the plurality of groove are configured with one or more features selected from the group consisting of:

i. each of the plurality of grooves is a continuous groove or a non-continuous groove, wherein when the groove is the non-continuous groove, the non-continuous groove comprises one or more uninterrupted portions of groove and one or more interruptions, wherein the one or more uninterrupted portions of groove have a ratio of length to width of at least 2:1, and wherein the one or more uninterrupted portions of groove have a cumulative arc angle of greater than 180 degrees;

ii. each of the plurality of grooves has a depth of at least 3% of a diameter of the ball;

iii. each of the plurality of grooves has a protrusion angle of less than 15 degrees relative to a radius of the ball that extends to a center of the groove at a surface of the ball;

iv. each of the plurality of grooves has a sidewall having a protrusion angle of less than 30 degrees relative to a radius of the ball that extends to the sidewall at a surface of the ball; and v. each of the plurality of grooves has two opposing sidewalls having protrusion angles less than 30 degrees relative to each other;

m. the plurality of grooves are arcuate grooves concentric about an axis of the ball that is perpendicular to the equator; and n. the sports ball further comprises a concavity, wherein the concavity is in the first hemisphere at a pole of the axis of the ball that is perpendicular to the equator.

8. The sports ball of claim 1, wherein the ball has a circumference of about 12 inches or about 9 inches.

9. A method comprising a. providing a sports ball of claim 1; and b. orienting the ball such that the first hemisphere is set laterally to the first side of the center plane of the drive wheel of the pitching machine such that the axis of rotation of the ball extends from the first hemisphere to the second hemisphere, wherein, when the drive wheel projects the ball, the trajectory of the projected ball is offset laterally toward the second side of the center plane opposite the first side.

10. The sports ball of claim 7, wherein the second hemisphere does not comprise grooves or wherein arcuate grooves are provided to a greater extent on the first hemisphere than the second hemisphere.

11. The sports ball of claim 7, wherein the plurality of grooves are configured such that when the ball is projected from the drive wheel of the pitching machine such that the axis of rotation of the ball is between the first hemisphere and the second hemisphere, the trajectory of the ball is higher when the ball was loaded on the drive wheel such that the wheel-ball interaction is dominated by the first hemisphere compared to when the ball was loaded on the drive wheel such that the wheel-ball interaction is dominated by the second hemisphere.

12. The sports ball of claim 7, wherein the second hemisphere comprises a plurality of dimples.

13. The sports ball of claim 7, wherein the plurality of grooves consists of 2 grooves or 3 grooves.

14. The sports ball of claim 7, wherein the ball has a circumference of about 12 inches or about 9 inches.

15. A method comprising a. providing a sports ball of claim 7; and b. orienting the ball such that the first hemisphere is set laterally to the first side of the center plane of the drive wheel of the pitching machine such that the axis of rotation of the ball extends from the first hemisphere to the second hemisphere, wherein, when the drive wheel projects the ball, the trajectory of the projected ball is offset laterally toward the second side of the center plane opposite the first side.

16. The sports ball of claim 7, wherein the ball has a circumference of about 12 inches or about 9 inches.

17. A method comprising a. providing a sports ball of claim 7; and b. orienting the ball such that the first hemisphere is set laterally to the first side of the center plane of the drive wheel of the pitching machine such that the axis of rotation of the ball extends from the first hemisphere to the second hemisphere, wherein, when the drive wheel projects the ball, the trajectory of the projected ball is offset laterally toward the second side of the center plane opposite the first side.

* * * * *